US007334990B2

(12) United States Patent
Lawlor et al.

(10) Patent No.: US 7,334,990 B2
(45) **Date of Patent: *Feb. 26, 2008**

(54) SUPERSONIC COMPRESSOR

(75) Inventors: Shawn P. Lawlor, Bellevue, WA (US); Mark A. Novaresi, San Diego, CA (US); Charles C. Cornelius, Kirkland, WA (US)

(73) Assignee: Ramgen Power Systems, Inc., Bellevue, WA (US)

( * ) Notice: Subject to any disclaimer, the term of this patent is extended or adjusted under 35 U.S.C. 154(b) by 353 days.

This patent is subject to a terminal disclaimer.

(21) Appl. No.: 11/091,680

(22) Filed: Mar. 28, 2005

(65) Prior Publication Data

US 2006/0034691 A1 Feb. 16, 2006

Related U.S. Application Data

(63) Continuation-in-part of application No. 10/355,784, filed on Jan. 29, 2003, now abandoned.

(60) Provisional application No. 60/352,943, filed on Jan. 29, 2002.

(51) Int. Cl.
*B63H 11/00* (2006.01)

(52) U.S. Cl. ..... 416/20 R; 416/21; 416/22

(58) Field of Classification Search ..... 415/70, 415/76, 81; 416/20 R, 20 A, 21, 22
See application file for complete search history.

(56) References Cited

U.S. PATENT DOCUMENTS 2,435,236 A 2/1948 Redding
2,570,081 A 10/1951 Szczeniowski
2,579,049 A 12/1951 Price
2,623,688 A 12/1952 Davidson (Continued)

FOREIGN PATENT DOCUMENTS

EP 0375198 A2 6/1990

(Continued)

OTHER PUBLICATIONS

Patent Abstracts of Japan, Application No. 10155771, Application Date: Jun. 4, 1998. Applicant Mayekawa Mfg. Co.; Inventors: Yamamoto Makoto et al, High Pressure Generating Method And Compressor Using This Method:. Date of Application Publication: Dec. 21, 1999. (3 pages).

(Continued)

*Primary Examiner*—Hoang Nguyen
(74) *Attorney, Agent, or Firm*—R. Reams Goodloe, Jr.

(57) ABSTRACT

A gas compressor based on the use of a driven rotor having an axially oriented compression ramp traveling at a local supersonic inlet velocity (based on the combination of inlet gas velocity and tangential speed of the ramp) which forms a supersonic shockwave axially, between adjacent strakes. In using this method to compress inlet gas, the supersonic compressor efficiently achieves high compression ratios while utilizing a compact, stabilized gasdynamic flow path. Operated at supersonic speeds, the inlet stabilizes an oblique/normal shock system in the gasdyanamic flow path formed between the gas compression ramp on a strake, the shock capture lip on the adjacent strake, and captures the resultant pressure within the stationary external housing while providing a diffuser downstream of the compression ramp.

54 Claims, 10 Drawing Sheets

U.S. PATENT DOCUMENTS

| | | | |
|---|---|---|---|
| 2,628,768 | A | 2/1953 | Kantrowitz |
| 2,648,493 | A | 8/1953 | Stalker |
| 2,659,528 | A | 11/1953 | Price |
| 2,689,681 | A | 9/1954 | Sabatiuk |
| 2,710,136 | A | 6/1955 | De Ganahl et al. |
| 2,721,693 | A | 10/1955 | Fabri et al. |
| 2,749,027 | A | 6/1956 | Stalker |
| 2,763,426 | A | 9/1956 | Erwin |
| 2,792,983 | A | 5/1957 | Stalker |
| 2,797,858 | A | 7/1957 | Von Der Nuell |
| 2,805,818 | A | 9/1957 | Ferri |
| 2,806,645 | A | 9/1957 | Stalker |
| 2,819,837 | A | 1/1958 | Loeb |
| 2,830,753 | A | 4/1958 | Stalker |
| 2,834,573 | A | 5/1958 | Stalker |
| 2,839,239 | A | 6/1958 | Stalker |
| 2,841,325 | A | 7/1958 | Weise |
| 2,853,227 | A | 9/1958 | Beardsley |
| 2,918,254 | A | 12/1959 | Hausammann |
| 2,934,259 | A | 4/1960 | Hausmann |
| 2,935,246 | A | 5/1960 | Roy |
| 2,943,839 | A | 7/1960 | Birmann |
| 2,944,786 | A | 7/1960 | Angell et al. |
| 2,947,139 | A | 8/1960 | Hausmann |
| 2,949,224 | A | 8/1960 | Pavlecka |
| 2,953,295 | A | 9/1960 | Stalker |
| 2,955,747 | A | 10/1960 | Schwaar |
| 2,956,732 | A | 10/1960 | Stalker |
| 2,966,028 | A | 12/1960 | Johnson et al. |
| 2,967,013 | A | 1/1961 | Dallenbach et al. |
| 2,970,750 | A | 2/1961 | Swearingen |
| 2,974,857 | A | 3/1961 | Schwaar |
| 2,974,858 | A | 3/1961 | Koffel et al. |
| 2,974,927 | A | 3/1961 | Johnson |
| 2,989,843 | A | 6/1961 | Ferri |
| 2,991,929 | A | 7/1961 | Stalker |
| 3,001,364 | A | 9/1961 | Woodworth |
| 3,010,642 | A | 11/1961 | Dickmann et al. |
| 3,054,255 | A | 9/1962 | Stratford |
| 3,088,279 | A | 5/1963 | Diedrich |
| 3,118,277 | A | 1/1964 | Wormser |
| 3,145,915 | A | 8/1964 | Marchal et al. |
| 3,156,407 | A | 11/1964 | Bourquard |
| 3,184,152 | A | 5/1965 | Bourquard |
| 3,269,120 | A | 8/1966 | Sabatiuk |
| 3,356,289 | A | 12/1967 | Plotkowiak |
| 3,422,625 | A | 1/1969 | Harris |
| 3,442,441 | A | 5/1969 | Dettmering |
| 3,447,740 | A | 6/1969 | Fabri et al. |
| 3,524,458 | A | 8/1970 | Goldsmith |
| 3,541,790 | A | 11/1970 | Kellett |
| 3,588,270 | A | 6/1971 | Boelcs |
| 3,658,437 | A | 4/1972 | Soo |
| 3,692,425 | A | 9/1972 | Erwin |
| 3,719,426 | A | 3/1973 | Friberg |
| 3,724,968 | A | 4/1973 | Friberg et al. |
| 3,765,792 | A | 10/1973 | Exley |
| 3,771,925 | A | 11/1973 | Friberg et al. |
| 3,824,029 | A | 7/1974 | Fabri et al. |
| 3,873,229 | A | 3/1975 | Mikolajczak et al. |
| 3,904,308 | A | 9/1975 | Ribaud |
| 3,904,312 | A | 9/1975 | Exley |
| 3,917,434 | A | 11/1975 | Bandukwalla |
| 3,956,887 | A | 5/1976 | MacDonald |
| 3,971,209 | A | 7/1976 | De Chair |
| 3,989,406 | A | 11/1976 | Bliss |
| 3,993,414 | A | 11/1976 | Meauze et al. |
| RE29,128 | E | 2/1977 | Sohre |
| 4,006,997 | A | 2/1977 | Friberg et al. |
| 4,011,028 | A | 3/1977 | Borsuk |
| 4,012,165 | A | 3/1977 | Kraig |
| 4,012,166 | A | 3/1977 | Kaesser et al. |
| 4,070,824 | A | 1/1978 | Traut |
| 4,123,196 | A | 10/1978 | Prince, Jr. et al. |
| 4,156,344 | A | 5/1979 | Cuthbertson et al. |
| 4,199,296 | A | 4/1980 | De Chair |
| 4,212,585 | A | 7/1980 | Swarden et al. |
| 4,241,576 | A | 12/1980 | Gertz |
| RE30,720 | E | 8/1981 | Sohre |
| 4,408,957 | A | 10/1983 | Kurzrock et al. |
| 4,445,816 | A | 5/1984 | Ribaud et al. |
| 4,479,755 | A | 10/1984 | Skoe |
| 4,678,398 | A | 7/1987 | Dodge et al. |
| 5,123,811 | A | 6/1992 | Kuroiwa |
| 5,277,549 | A | 1/1994 | Chen et al. |
| 5,286,162 | A | 2/1994 | Veres |
| 5,445,496 | A | 8/1995 | Brasz |
| 5,554,000 | A | 9/1996 | Katoh et al. |
| 5,676,522 | A | 10/1997 | Pommel et al. |
| 5,704,764 | A | 1/1998 | Chupp et al. |
| 5,709,076 | A | 1/1998 | Lawlor |
| 5,782,079 | A | 7/1998 | Chiang et al. |
| 6,017,186 | A | 1/2000 | Hoeger et al. |
| 6,263,660 | B1 | 7/2001 | Lawlor |
| 6,279,309 | B1 | 8/2001 | Lawlor et al. |
| 6,298,653 | B1 | 10/2001 | Lawlor et al. |
| 6,334,299 | B1 | 1/2002 | Lawlor |
| 6,434,924 | B1 | 8/2002 | Lawlor et al. |
| 6,446,425 | B1 | 9/2002 | Lawlor |
| 6,488,469 | B1 | 12/2002 | Youssef et al. |
| 6,507,125 | B1 | 1/2003 | Choi |
| RE38,040 | E | 3/2003 | Spear et al. |
| 6,682,301 | B2 | 1/2004 | Kuhne |
| 6,694,743 | B2 | 2/2004 | Lawlor et al. |
| 2002/0073714 | A1 | 6/2002 | Yim et al. |
| 2005/0271500 | A1* | 12/2005 | Lawlor et al. ..... 415/1 |
| 2006/0021353 | A1* | 2/2006 | Lawlor et al. ..... 60/772 |

FOREIGN PATENT DOCUMENTS

| | | |
|---|---|---|
| FR | 863484 | 1/1941 |
| GB | 648647 | 1/1951 |
| JP | HEI 11-351191 A | 12/1999 |
| JP | 2001-295775 A | 10/2001 |

OTHER PUBLICATIONS

Patent Abstracts of Japan, Application No. 2001104506, Application Date: Jun. 4, 1998. Applicant Mayekawa Mfg. Co.; Inventors: Yamamoto Makoto et al, "High Pressure Compressor". Date of Application Publication: Oct. 26, 2001. (2 pages).

* cited by examiner

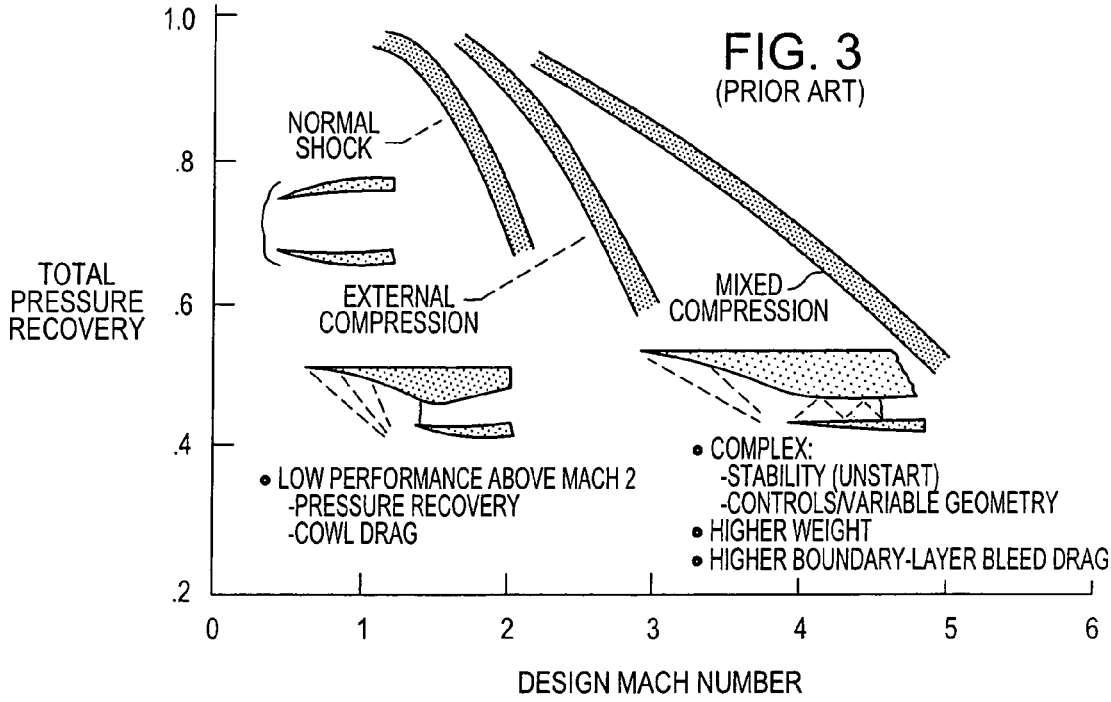
FIG. 3
(PRIOR ART)
TOTAL PRESSURE RECOVERY
1.0
.8
.6
.4
.2
NORMAL SHOCK
EXTERNAL COMPRESSION
MIXED COMPRESSION
• LOW PERFORMANCE ABOVE MACH 2
-PRESSURE RECOVERY
-COWL DRAG
• COMPLEX:
-STABILITY (UNSTART)
-CONTROLS/VARIABLE GEOMETRY
• HIGHER WEIGHT
• HIGHER BOUNDARY-LAYER BLEED DRAG
0
1
2
3
4
5
6
DESIGN MACH NUMBER

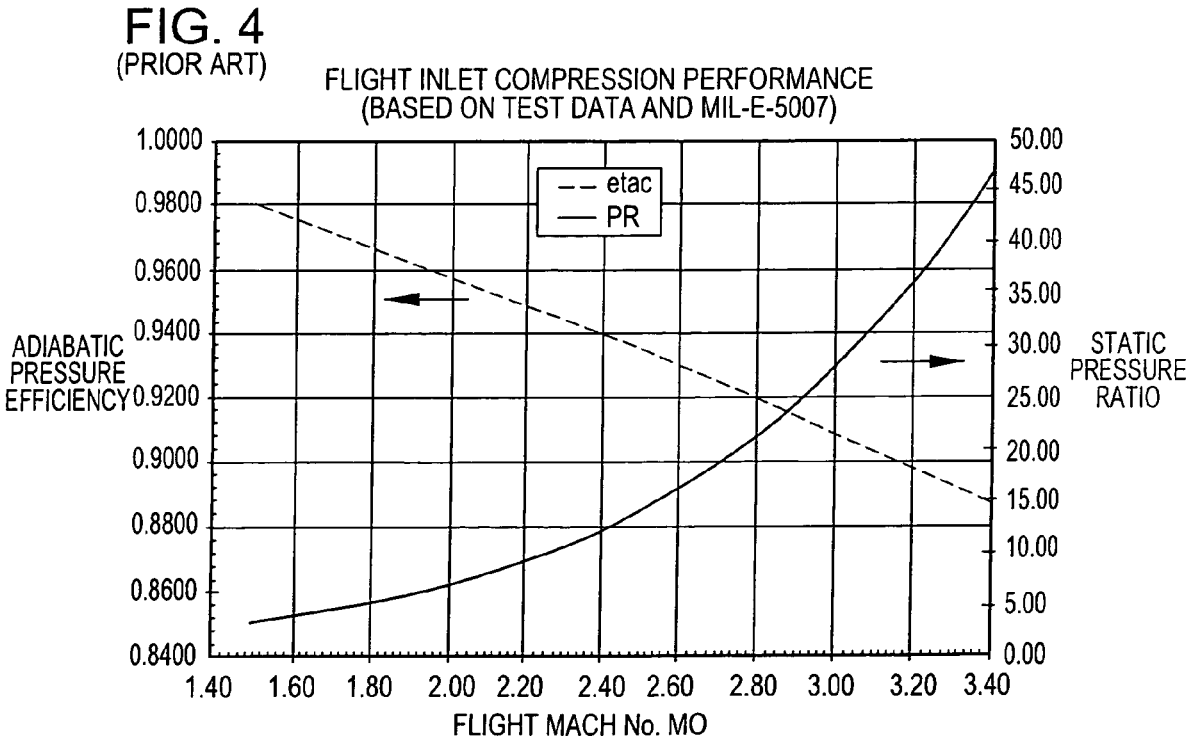
FIG. 4
(PRIOR ART)
FLIGHT INLET COMPRESSION PERFORMANCE
(BASED ON TEST DATA AND MIL-E-5007)
etac
PR
ADIABATIC PRESSURE EFFICIENCY
1.0000
0.9800
0.9600
0.9400
0.9200
0.9000
0.8800
0.8600
0.8400
STATIC PRESSURE RATIO
50.00
45.00
40.00
35.00
30.00
25.00
20.00
15.00
10.00
5.00
0.00
1.40
1.60
1.80
2.00
2.20
2.40
2.60
2.80
3.00
3.20
3.40
FLIGHT MACH No. MO

MIXED COMPRESSION INLET SHOCK SYSTEM AT DESIGN MACH NO.

MIXED COMPRESSION INLET SHOCK SYSTEM

MIXED COMPRESSION INLET

SUPERSONIC COMPRESSOR

RELATED PATENT APPLICATIONS

This application is a Continuation-In-Part of prior U.S. patent application Ser. No. 10/355,784 filed Jan. 29, 2003, now abandoned entitled SUPERSONIC COMPRESSOR, (assigned of record on Mar. 16, 2004 and Mar. 29, 2004 and recorded on Apr. 19, 2004 at Reel/Frame 015229/0879 to Ramgen Power Systems, Inc. of Bellevue, Wash.), which utility application claimed priority from prior U.S. Provisional Patent Application Ser. No. 60/352,943, filed on Jan. 29, 2002, the disclosures of which are incorporated herein in their entirety by this reference, including the specification, drawings, and claims of each application.

STATEMENT OF GOVERNMENT INTEREST

This invention was made with United States Government support under Contract No. DE-FC026-00NT40915 awarded by the United States Department of Energy. The U.S. Government has certain rights in the invention.

COPYRIGHT RIGHTS IN THE DRAWING

A portion of the disclosure of this patent document contains material that is subject to copyright protection. The applicant no objection to the facsimile reproduction by anyone of the patent document or the patent disclosure, as it appears in the Patent and Trademark Office patent file or records, but otherwise reserves all copyright rights whatsoever.

TECHNICAL FIELD

This invention relates to the field of fluid compression. More particularly, the invention relates to a high efficiency, novel gas compressor in which saving of power as well as improved compression performance and durability are attained by the use of supersonic shock compression of the process gas. Compressors of that character are particularly useful for compression of air, refrigerants, steam, and hydrocarbons, or other gases, particularly heavy gases.

BACKGROUND

In axial flow compressors, as employed in conventional gas turbine engines, the Mach number of the flow relative to the individual rotor and/or stator blades is typically in the subsonic or transonic flow regime. Blade tip Mach numbers from about 0.5 Mach to about 0.7 Mach are common. Rotor/stator operation at Mach numbers in this range results in high lift to drag levels, with minimal shock losses for the rotor and stator blades. However, one of the disadvantages of such a design is that the pressure ratio that can be achieved across any given rotor/stator stage is typically limited to about 1.5:1. Yet, simple gas turbine systems that must achieve high cycle efficiency levels require overall compression ratios in excess of about 10:1. Further, systems with compression ratios up to about 25:1 have been demonstrated for applications with demanding performance requirements. Consequently, when there is a demand for high compression ratios, compressors with many stages of compression are provided. Unfortunately, such multi-staged compressors are relatively heavy, complex, and thus are expensive. As a result, there has been a continuing interest in the compressor design field to explore higher rotor/stator loadings, in order to deliver high compression ratios with fewer stages.

Further, the limitations imposed by low stage pressure ratios in subsonic compressors have stimulated the study, design, development, and testing of transonic and supersonic flow velocities in the rotor blades. Such a design approach provides a much greater amount of kinetic energy to the gas at each stage. With supersonic compressors of axial or mixed flow (i.e. using combinations of axial and radial flow), past designs have shown the potential to attain stage pressure ratios as high as 4 or even 6, with attendant adiabatic efficiencies of 75% to 80%. In such designs, it follows that high air handling ability is obtained with minimal frontal area, which is particularly important for flight applications. Furthermore, high pressure ratios per stage means that fewer stages are required, with resultant saving in compressor weight and expense.

High compression ratios per stage have been provided by several types of designs. In supersonic designs, shock waves may be handled in the stator, or in the rotor, or both. No matter where the shocks occur, the basic design criteria is to minimize the pressure loss and to insure flow stability over as wide of an operating range as possible. One type of prior art blade configuration that accomplishes shock compression within the rotor flow is illustrated in FIG. 1. There, a rotor operating at an inlet Mach number of 1.8 provides a first rotor blade $R_1$ which generates a first shock $S_1$ which is captured and reflected in the form of a second, oblique shock $S_2$ by the adjacent rotor blade $R_2$. Resultant downstream flow decelerates behind the third shock $S_3$ to a Mach number of 0.75, and, after expansion to a Mach number of 0.5. For achievable supersonic blade tip Mach numbers, considerable static pressure rise is obtained in the rotor itself. Yet, one of the disadvantages of such a rotor blade design has been the loss incurred in the subsonic diffusion process, due to separation occurring from interaction between the normal shock $S_3$ and the boundary layer.

As an initial step in an attempt to overcome the shortcomings inherent in presently available compressor designs, we have evaluated the performance of various supersonic flight inlets. Most manned aircraft and many missiles rely on some form of air-breathing propulsion for sustained flight within the earth's atmosphere. Air breathing engines require an inlet to diffuse air from the free-stream velocity to a lower velocity that is acceptable for further processing by other engine components. The inlet components are designed to capture the exact amount of air required, and to accomplish diffusion with a minimum of total pressure loss. Importantly, such inlets also must deliver the air to the subsequent components within acceptable levels of flow distortion. Such inlets must also be configured to contribute the lowest amount of external drag possible for a given application. Because a wide range of supersonic air-breathing propulsion systems have been designed, developed, and tested over the last 60 years, the optimization of supersonic inlet configurations for various flight applications has received a great deal of attention. As a result, many techniques are known in that art for maximizing the performance of supersonic inlets. In fact, performance levels of such inlets have been well established over a wide range of operational flight Mach numbers.

Attention is directed to FIG. 2, wherein the supersonic inlet performance (as represented by the total pressure recovery) is shown as a function of flight Mach number, for a wide range of supersonic inlet systems. The various inlet performance data points shown on this plot represent actual test data from supersonic inlet systems of many different configurations that have been designed to operate over a wide flight Mach number range, while exposed to a range of angle of attack attitudes and yaw angles. Examples are provided for specific designs by Pratt & Whitney (P&W), United Technologies (UTRC), the NASA Hypersonic Research Engine (HRE), the US Army Transportation Material Command (TMC), and the National Aeronautics and Space Administration (NASA) TMX 413 design. Additionally, the nominal inlet performance requirement set forth in United States Military Specification MIL-E-5007 is illustrated. In short, the peak performance levels of each of the noted systems have been compromised to achieve the robust operability and stability requirements of a true flight system that must complete a mission wherein a wide range of inlet flow conditions are encountered.

For categorizing anticipated performance characteristics, and for evaluation and comparison purposes, supersonic flight inlet designs are often defined into three broad groups. These groups are (a) normal shock inlets, (b) external compression inlets, and (c) mixed compression inlets. These three different groups are depicted in FIG. 3, along with a relative representation of performance levels for each group as a function of design Mach number. As can be appreciated by reference to FIG. 3, each of these three types of inlets has advantages and disadvantages. The normal shock inlet exhibits excellent pressure recovery at relatively low Mach number, but recovery drops markedly as design Mach number increases. The external compression inlet shows good pressure recovery in the Mach 2 range, but also drops off markedly as the operating Mach number increases above this design range. The mixed compression inlet provides acceptable pressure recovery over a relatively broad range of design Mach numbers, but again, efficiency drops off markedly as the operating Mach number reaches 4 or more.

Referring again to FIG. 2, performance data is included for all three types of inlet that were depicted in FIG. 3, as can generally be appreciated by the range provided for flight Mach numbers across which the various designs operate. Importantly, it can be appreciated that a properly designed supersonic inlet that is optimized for operation at a single Mach number (or a small operating Mach number range), with minimal variability in angle or attack or in yaw exposure, could achieve performance levels somewhat greater than the performance levels indicated in FIG. 2.

Further, in FIG. 4, nominal inlet performance requirements as delineated in Military Specification MIL-E-5007 are provided. First, this figure provides a curve that corresponds to the mean line of the flight inlet performance, expressed as static pressure ratio, derived from the curve for the MIL-E-5007 inlet depicted in FIG. 2. Second, based on the first derived curve, FIG. 4 provides a curve that corresponds to the mean line of flight inlet performance expressed as adiabatic (isentropic) compression efficiency as a function of flight Mach number. For example, at a flight Mach number of 2.4, the MIL-E-5007 specification inlet will provide compressor performance at 94% adiabatic efficiency.

Total pressure recovery is commonly used by flight inlet designers to evaluate the performance of such systems. The total pressure recovery is the ratio of the total pressure of the flow leaving the inlet to the free stream total pressure level. The flight Mach number can also be thought of as quantifying the magnitude of the total pressure available to an inlet. Thus, it is possible for any given flight Mach number and total pressure recovery level to calculate a corresponding system pressure ratio. The pressure ratio is a critical factor for all compression applications.

In FIG. 5, the compression efficiency for the flight inlet data shown in FIGS. 2 and 4 has been averaged, and reduced to a single functional line where adiabatic compression efficiency is illustrated as a function of inlet static pressure ratio. Thus, FIG. 5 represents the basic efficiency characteristics of a wide range of flight inlets as a function of static pressure ratio. Importantly, this comparison allows the generalized efficiency of flight inlets to be directly compared to the performance of (a) centrifugal compressors, and (b) axial flow compressors, in terms of adiabatic (isentropic) compression efficiency. To facilitate this comparison, the adiabatic (isentropic) compression efficiency of a number of selected axial flow industrial gas turbine compressors are shown in this FIG. 5. It can readily be appreciated from FIG. 5 that supersonic flight inlet designs have the potential to operate at significantly greater efficiencies than heretofore known centrifugal compressors or conventional axial flow turbo-compressors.

The isentropic compressor efficiency (sometimes referred to as the adiabatic compressor efficiency) is a performance parameter commonly used by compressor designers. This is based on a theoretical frictionless adiabatic compression process, and thus also is known as isentropic, or having a constant entropy. Although it is evident that compression is not frictionless, and that friction results in heating of the metal parts of the compressor, the assumption that adiabatic compression takes place may be used in computing the theoretical power requirements for a particular compression requirement. The isentropic compressor efficiency is defined as the ratio of isentropic work of compression to the actual work of compression. Equation 1 shows the definition for the isentropic compressor efficiency:

$$\eta\text{comp}=(h_{t2i}-h_{t1})/(h_{t2a}-h_{t1})$$

Although a variety of supersonic gas compressor and compressor diffuser designs have been heretofore proposed, in so far as we are aware, none have been widely utilized for primary compressor service, whether for common applications such as air or steam, or heavier gases such as certain refrigerants, or heavy chemical intermediates such as uranium hexafluoride. Undoubtedly, improvements in compression efficiency, which would be especially advantageous in order to reduce energy costs for a particular compression service, would be desirable. In various attempts to achieve such improvements, many different methods and structures have been tried, either experimentally or commercially. Some of such attempts have included the use of various shock patterns, such as adapted from conventional centrifugal compressor wheels, or incorporating various multiple rotor configurations. The challenge, however, has been in the selection of methods and structures that assure adequate performance (including such acceptability of attributes such as starting performance, overall efficiency, and acoustic stability) while reducing capital and operating costs. It would be especially desirable for compressors operating under such conditions to have an inlet and diffuser configuration that would be resistant to small changes about a design point with respect to external flow field dynamics and shock perturbations.

Consequently, it would be desirable to provide a reliable supersonic gas compressor, specifically including a compressor and diffuser chamber structure that enables the compressor to maintain high isentropic efficiency with a minimum of structure, while operating at a high pressure ratio. Therefore, a continuing demand exists for simple, highly efficient and inexpensive gas compressors as may be useful in a wide variety of gas compression applications. This is because many gas compression applications could substantially benefit from incorporating a compressor that offers a significant efficiency improvement over currently utilized designs. In view of ever increasing energy costs, particularly for both electricity and for natural gas, it would be desirable to attain significant cost reduction in utility expense for gas compression. Importantly, it would be quite advantageous to provide a novel compressor which provides improvements (1) with respect to operating energy costs, (2) with respect to reduced first cost for the equipment, and (3) with respect to reduced maintenance costs. Fundamentally, particularly from the point of view of reducing long term energy costs, this would be most effectively accomplished by attaining gas compression at a higher overall compression efficiency than is currently known or practiced industrially. Thus, the important advantages of a new gas compressor design providing the desirable feature of improved efficiency can be readily appreciated.

SUMMARY

We have now invented a gas compressor based on the use of a driven rotor having a substantially axial compression ramp traveling at a local supersonic inlet velocity (based on the combination of inlet gas velocity and tangential speed of the ramp) which compresses inlet gas by use of supersonic shock wave located substantially axially between an upstream strake and a downstream strake, while containing the compressed gas via a stationary sidewall housing. In using this method to compress inlet gas, the supersonic compressor efficiently achieves high compression ratios while utilizing a compact, stabilized gasdynamic flow path. Operated at supersonic speeds, the inlet stabilizes an oblique/normal shock system in the gasdynamic flow path formed between the upstream strake and the downstream strake, while retaining the compressed gas against a stationary external housing. And, to provide for ease of start, and to improve operating efficiency, an inlet bleed air system is provided to remove boundary layer air downward through selected rim segments and out through rotor internals.

The structural and functional elements incorporated into this novel compressor design overcomes significant and serious problems which have plagued earlier attempts at supersonic compression of gases in industrial applications. First, at the design Mach numbers at which my device can be engineered to operate may be in the range from about Mach 1.5 or slightly lower to about Mach 4.0, the design minimizes aerodynamic drag. This is accomplished by both careful design of the shock geometry, as related to the upstream and downstream strakes and rotating compression ramp, as well as by effective use of a boundary layer control and drag reduction techniques. Thus, the design minimizes parasitic losses to the compression cycle due to the flow field distortion resulting from boundary layers and shock boundary layer interactions. This is important commercially because it enables a gas compressor to avoid large parasitic losses that undesirably consume energy and reduce overall plant efficiency.

Also, more fundamentally, this compressor design can develop high compression ratios with very few aerodynamic leading edges. The individual leading edges of the thousands of rotor and stator blades in a conventional high pressure ratio compressor, especially as utilized in the gas turbine industry, contribute to the vast majority of the viscous drag loss of such systems. However, in that the design of the novel gas compressor disclosed herein utilizes, in one embodiment, only a handful of individual aerodynamic leading edges that are subjected to stagnation pressure, viscous losses are significantly reduced, compared to conventional gas compression units heretofore known or utilized. As a result, the novel compressor disclosed and claimed herein has the potential to be much more efficient than a conventional gas turbine compressor, when compared at competing compression ratios.

Second, the selection of materials and the mechanical design of rotating components avoids the use of excessive quantities or weights of materials (a vast improvement over large rotating mass bladed centrifugal compressor designs). Yet, the design provides the necessary strength, particularly tensile strength where needed in the rotor, commensurate with the centrifugal forces acting on the extremely high speed rotating components.

Third, the design provides for effective mechanical separation of the low pressure incoming gas from the exiting high pressure gases, while allowing gas compression operation along a circumferential pathway. The novel design enables the use of lightweight components in the gas compression pathway.

To solve the above mentioned problems, we have now developed compressor design(s) which overcome the problems inherent in the heretofore known apparatus and methods known to us which have been proposed for the application of supersonic gas compression in industrial applications. Of primary importance, we have now developed a low drag rotor which has an upstream strake and a downstream strake, and one or more gas compression ramps mounted on at least one of the upstream strake and/or the downstream strake. A number N of peripherally, preferably partially helically extending strakes S partition the entering gas flow sequentially to the inlet to a first one of the one or more strake mounted gas compression ramps, and then to a second one of the one or more strake mounted gas compression ramps, and so on to an Nth one of the one or more strake mounted gas compression ramps. Each of the strakes S has an upstream or inlet side and a downstream or outlet side. For rotor balance and gas compression efficiency purposes, in one embodiment the one gas compression ramp is provided for each downstream strake. In another embodiment, one gas compression ramp is provided for each upstream strake. In yet another embodiment, one gas compression ramp is provided at each one of the downstream strakes and the upstream stakes. In one embodiment, the number of strakes N and the number X of gas compression ramps R are both equal to three. The pressure inherent in the compressed gases exiting from each compressive shock structure between the upstream and downstream strakes is efficiently captured at one or more diffuser structures located between diverging portions of upstream and downstream strakes. Moreover, the compressed gas is effectively prevented from "short circuiting" or returning to the inlet side of subsequent gas compression ramps by the strakes S. More fundamentally, the strakes S act as a large screw compressor fan or pump to move compressed gases along with each turn of the rotor.

To accommodate the specific strength requirements of high speed rotating service, various embodiments for an acceptable high strength rotor are feasible. In one embodiment, the rotor section may comprise a carbon fiber disc. In another, it may comprise a high strength steel hub. In each case, the strakes and accompanying gas compression ramps and diffuser(s) may be integrally provided, or rim segments including strake segments (with or without gas compression ramps) may be releasably and replaceably affixed to the rotor.

Attached at the radial edge of the outer surface of the rotor are one or more of the at least one strakes, which strakes each extend further radially outward to a strake tip very closely adjacent the interior peripheral wall of a stationary housing. At least one of the gas compression ramps are situated at one of the downstream or at one of the upstream strakes so as to engage and to compress that portion of the entering gas stream which is impinged by the gas compression ramp upon its rotation, to cause a supersonic shock wave that is captured between adjacent strakes. The compressed gases escape rearwardly from the gas diffuser portion, decelerate, and expand outwardly into a gas expansion diffuser space or volute, prior to entering a compressed gas outlet nozzle.

Finally, many variations in the gas flow configuration and providing gas passageways, may be made by those skilled in the art without departing from the teachings hereof. Finally, in addition to the foregoing, this novel gas compressor is simple, durable, and relatively inexpensive to manufacture and to maintain.

BRIEF DESCRIPTION OF THE DRAWING

In order to enable the reader to attain a more complete appreciation of the invention, and of the novel features and the advantages thereof, attention is directed to the following detailed description when considered in connection with the accompanying drawings, wherein:

FIG. 3 illustrates the total pressure recovery versus design Mach number for three basic supersonic compression inlets, namely (a) a normal shock inlet, (b) an external compression inlet, and (c) a mixed compression inlet.

FIG. 4 shows the flight inlet compression performance for a Military Specification MIL-E-5007 flight inlet, showing (a) static pressure ratio versus flight Mach number, and (b) adiabatic pressure efficiency versus flight Mach number.

The foregoing figures, being merely exemplary, contain various elements that may be present or omitted from actual implementations depending upon the circumstances. An attempt has been made to draw the figures in a way that illustrates at least those elements that are significant for an understanding of the various embodiments and aspects of the invention. However, various other elements and parameters are also shown and briefly described to enable the reader to understand how various optional features may be utilized in order to provide an efficient, reliable supersonic gas compressor.

DETAILED DESCRIPTION

Figure 7:
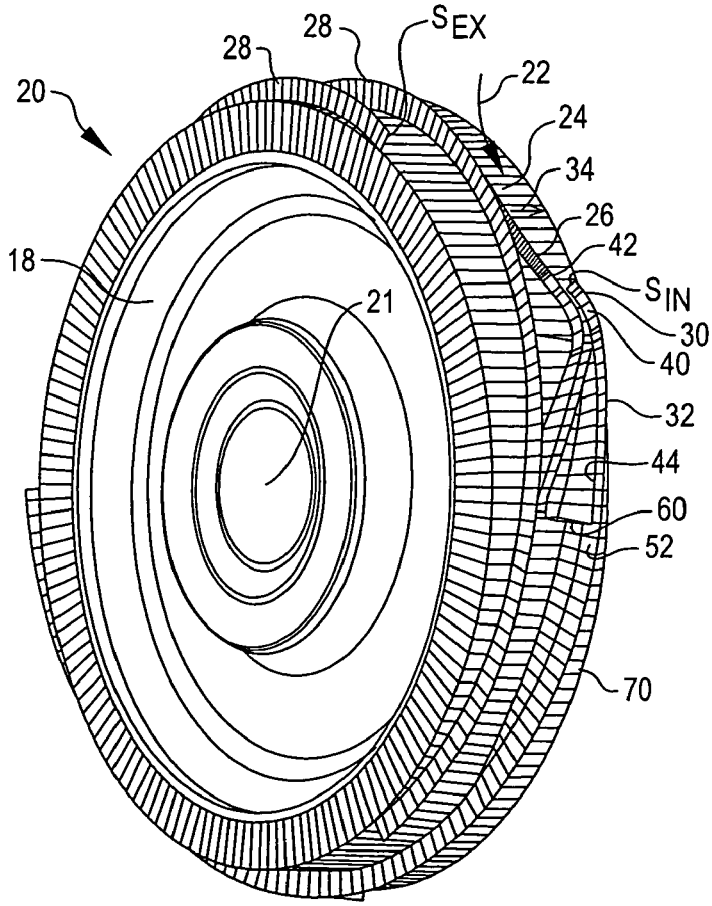
FIG. 7 illustrates a novel mixed compression supersonic compressor wheel which utilizes an axial shock structure, wherein a supersonic compression ramp is provided to create a shock system axially between adjacent strakes.
Figure 8:
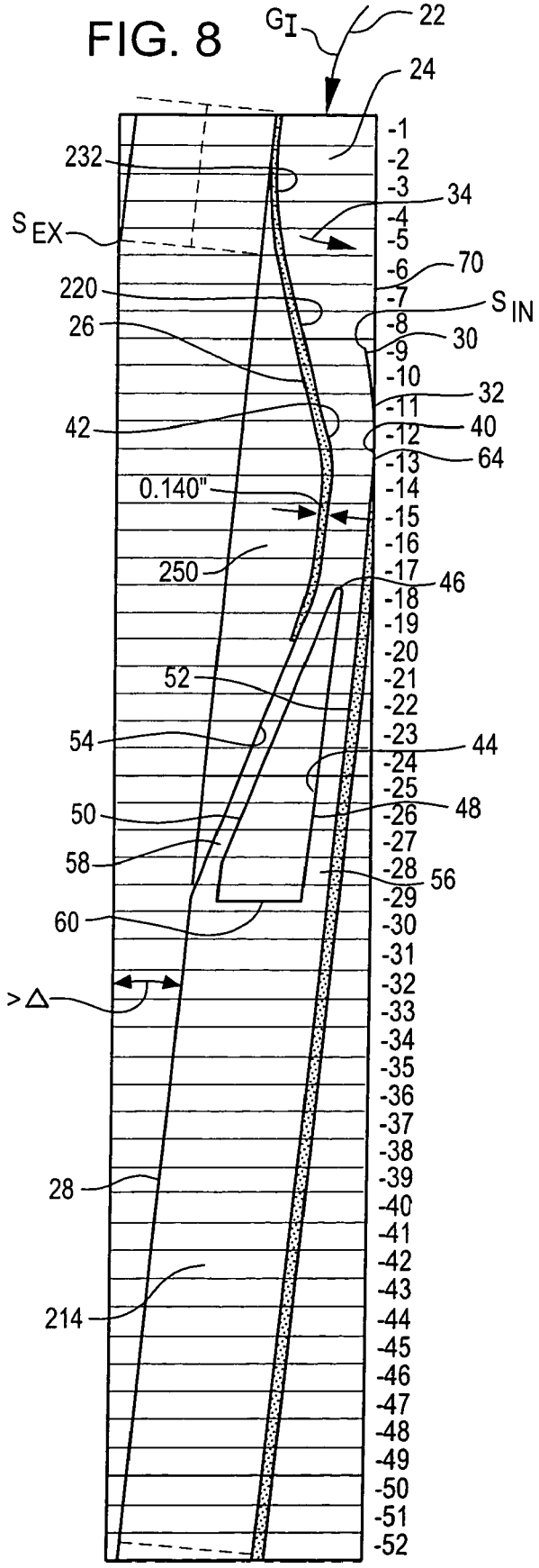
FIG. 8 illustrates a detailed view of the inlet and diffuser portions of the rotary supersonic compressor wheel just set forth in FIG. 7, viewed radially inward and looking at the circumference of the compressor wheel, and now showing each rim segment number as manufactured utilizing a plurality of rim segments to define the various aerodynamic components of the strakes, compression ramp, shock capture inlet lip on the upstream strake, and the diffuser which splits gas flow into two flow channels before a large diffusion chamber is reached between the upstream strake and the downstream strake.

A detailed view of an exemplary embodiment of a supersonic compressor rotor wheel 20 designed for utilization of axial supersonic shock patterns is provided in FIG. 7. Rotor disc portion 18 of wheel 20 supports a plurality of rim segments $M_1$ through $M_{52}$ mounted thereon, as further indicated in FIGS. 8 and 15. In FIG. 8, a series from 1 to 52 of rim segments ($M_1$ through $M_{52}$) are described in a circumferential manner as if looking radially face down toward the center 21 of rotor 20. Inlet fluid (such as air) as indicated by reference arrow 22 is supplied to the pre-inlet flow surface 24 at the outer periphery of the rotor wheel 20. The inlet fluid encounters a compression ramp 26 provided as a part of downstream strake 28.

A profiled, preferably smoothly curved cowl portion 30 of upstream strake 32, and having a strake shock capture inlet lip $S_{IN}$, is provided to capture a series of axially extending oblique shocks (see discussion below in conjunction with FIGS. 9). The compression ramp 26 provided as a part of downstream strake 20 serves to laterally compress inlet air and direct it primarily (substantially uni-directionally) in the direction of reference arrow 34. Under design supersonic speed inlet conditions, lip $S_{IN}$ of upstream, inlet strake 32 captures the oblique shockwave and directs entering air between inner wall 40 of upstream strake 30 strake and inner wall 42 of compression ramp 26. Captured, compressed fluid is eventually diffused via use of diffuser centerbody 44. In one embodiment, diffuser 44 comprises a substantially triangular structure having a leading edge 46. A first diffuser sidewall 48 and a second diffuser sidewall 50 act, in conjunction with inner wall portion 52 of upstream strake 32 and inner wall portion 54 of downstream strake 26, respectively, to provide first 56 and second 58 diffusion channels for the compressed fluid. A rear wall 60 is provided for diffuser 44. Behind the rear wall 60, the speed of captured fluid decreases and pressure increases. Compressed fluid is dumped at the exhaust outlet $S_{EX}$ of the downstream strake 28.

Note that the inlet end $S_{IN}$ of the upstream, or inlet strake 32 is preferably slightly inward of the outermost point 64 of the strake 30 toward the lateral edge 70 of rotor 20. This provides a unique contoured inlet cowl shape 30 to capture and compress inlet air, more specifically in the form of a mixed compression supersonic inlet. Such a shape provides for easier self starting and capture of the supersonic shock structure.

The compressor design taught herein uniquely applies various techniques of flight inlet design, in order to achieve performance optimization, with the advantages of high single stage pressure ratios, simplicity, and low cost of supersonic compressors to provide a high efficiency, low cost compression system especially adapted for ground based (stationary or mobile) compressor applications. Such a combination requires many novel, unique mechanical and aerodynamic features in order to achieve the aerodynamic requirements for a particular system design, without violating the mechanical design limits necessary to provide a safe, durable, robust compression system that can be manufactured utilizing proven and cost effective manufacturing techniques.

Figure 16:
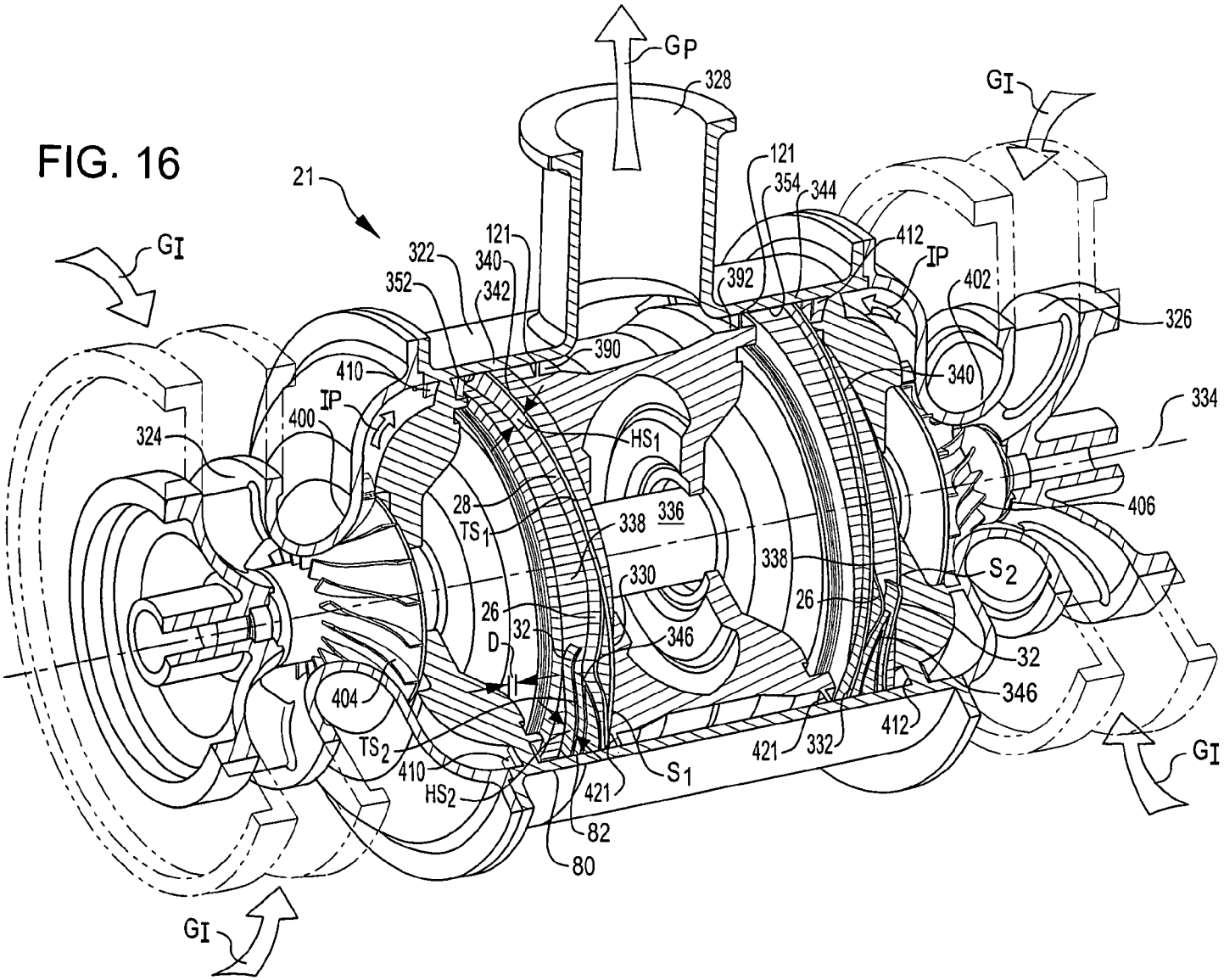
FIG. 16 provides a partially cut away perspective view of once embodiment of a compressor utilizing opposing rotors mounted on a common shaft, with each rotor having axial compression ramps as described herein.

One of the primary techniques utilized in the design of the compressors taught herein is to employ certain optimization techniques heretofore employed in supersonic flight inlets within the architecture of an enclosed, rotating disc system. Thus, one common element is to utilize a non-rotating compressor case or housing. As represented in FIG. 16, a substantially cylindrical stationary housing 80 having an interior peripheral wall 82 is utilized as one of the boundaries for the gas dynamic flow path. Basically, in the most simple terms, three of the surfaces of the supersonic inlet are formed by the moving surfaces integrated onto the rim of a high speed rotor 20, and one of the surfaces is the interior peripheral wall 82 of the non-rotating housing 80.

Figure 1:
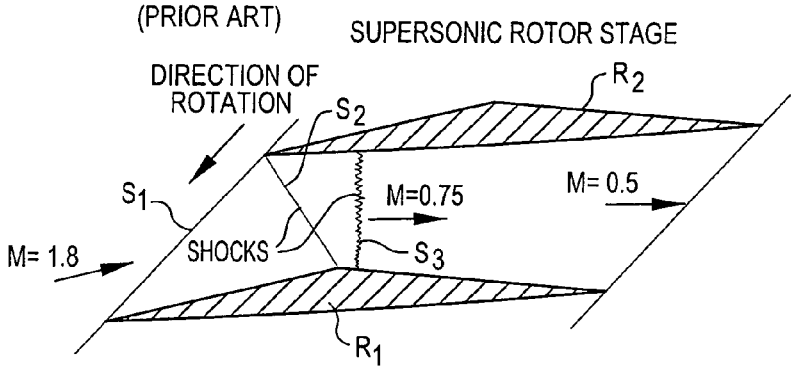
FIG. 1 (PRIOR ART)
FIG. 1 shows a sectioned view of a set of prior art rotor blades used in one supersonic turbo-compressor design.
Figure 2:
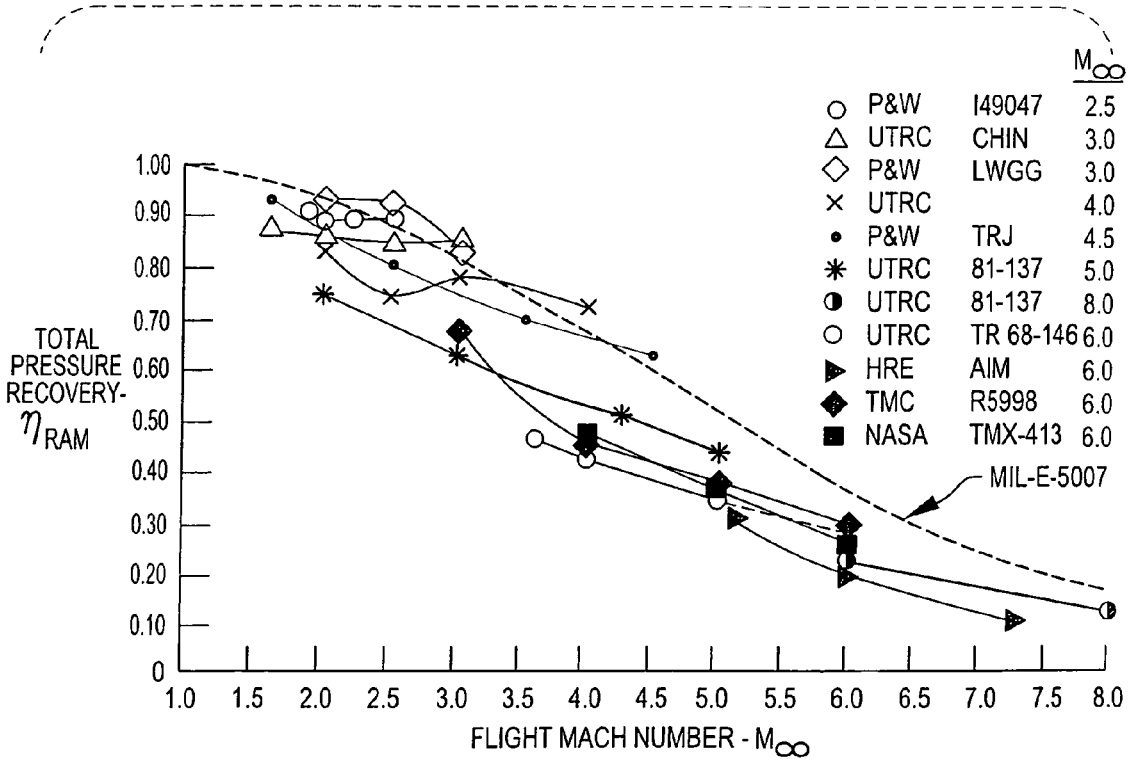
FIG. 2 (PRIOR ART)
FIG. 2 illustrates the total pressure recovery versus flight Mach number for a variety of supersonic flight inlet designs, including the United States Military Specification MIL-E-5007 design.
Figure 5:
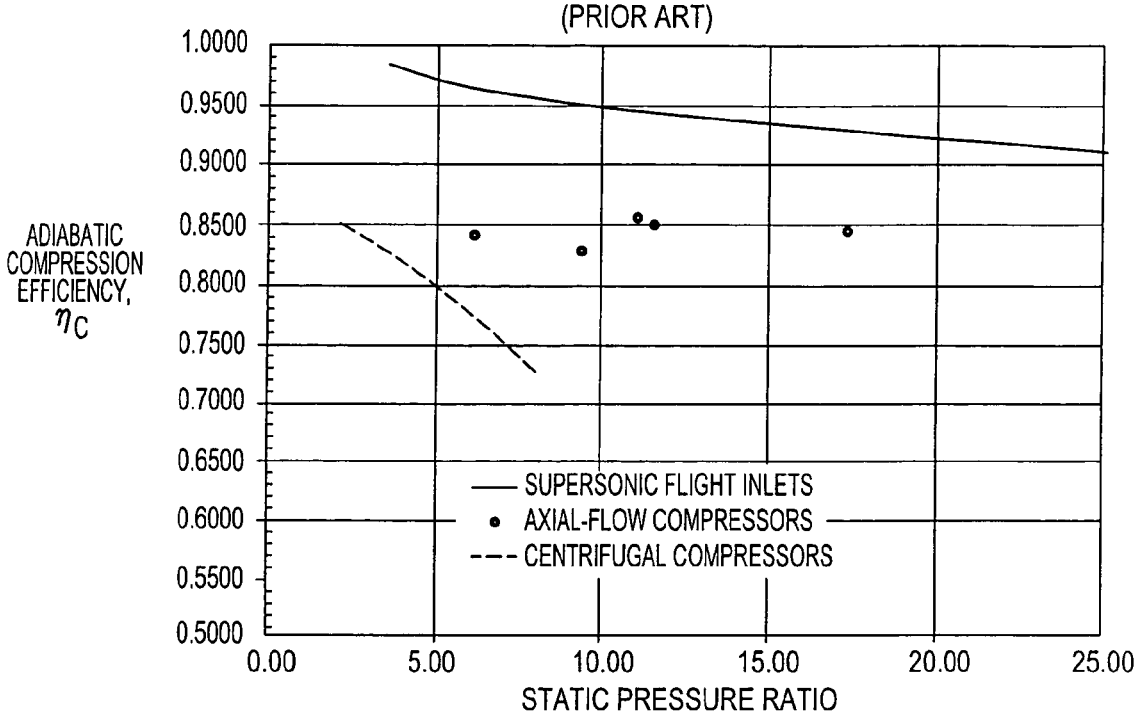
FIG. 5 (PRIOR ART)
FIG. 5 shows the comparative compression performance of (a) supersonic flight inlets, (b) axial flow compressors, and (c) centrifugal compressors, using a plot of adiabatic compression efficiency versus static pressure ratio.
Figure 6:
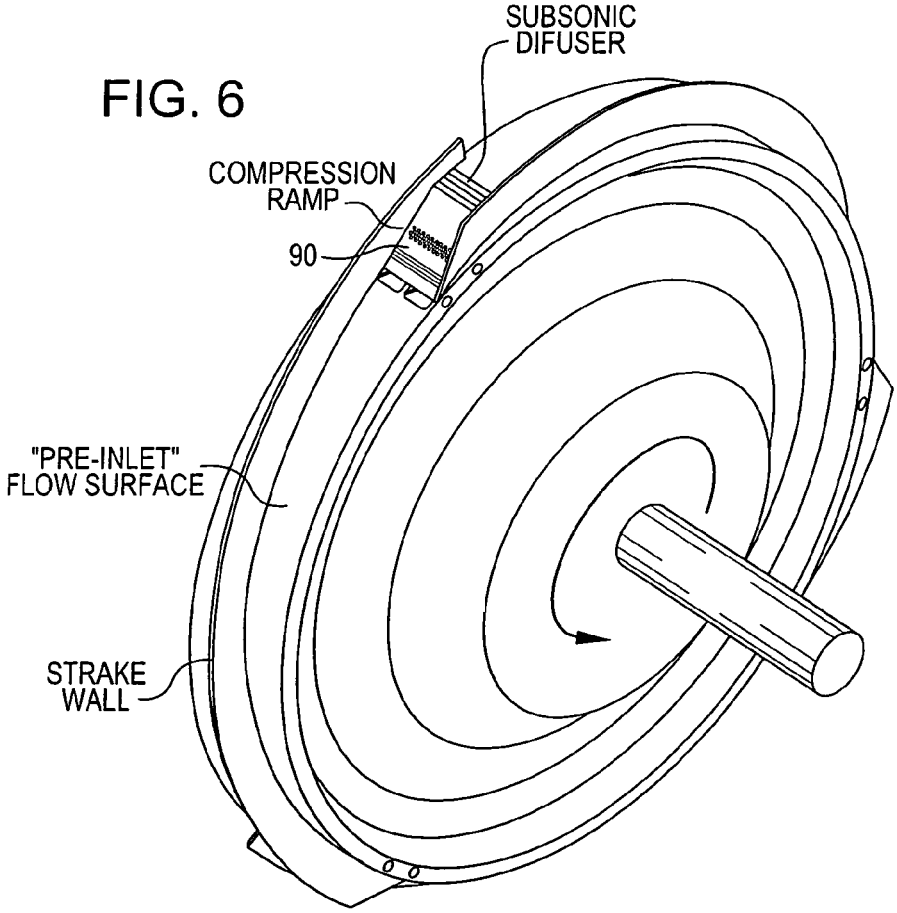
FIG. 6 shows one type of supersonic compressor which utilizes primarily a radial extending shock structure, created by flowing the gas to be compressed along a pre-inlet flow surface, and then against a radially outward compression ramp design to create a series of oblique shocks and a normal shock prior to an expansion portion downstream which provides a subsonic diffuser.
Figure 6A:
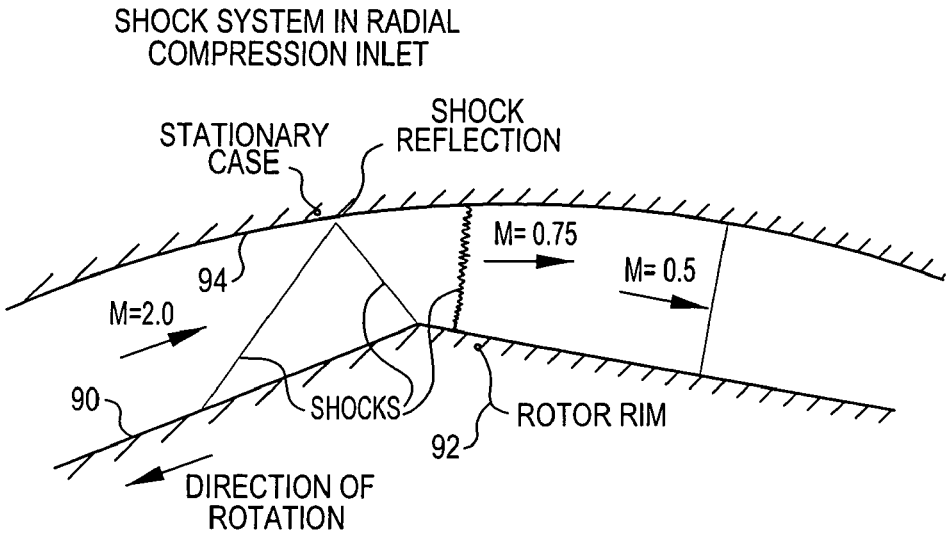
FIG. 6A illustrates the shock structure which is developed when utilizing the supersonic compressor of the design first set forth in FIG. 6, as created by flowing the gas to be compressed along a pre-inlet flow surface, and then against a radially outward compression ramp to create a series of oblique shocks and a normal shock prior to an expansion portion downstream which provides a subsonic diffuser.

In another design for a compressor, the generated supersonic shocks are generally radial in nature, as is illustrated in FIG. 6. In that design, the shocks generated by the compression ramp 90 on the rotor rim 92 coalesce and/or reflect off of the stationary interior wall 94, as illustrated in FIG. 6A.

However, it has now been found that it is possible to advantageously configure the compressive surfaces in a supersonic compressor so that an oblique shock system is provided that creates a compressive field in the axis of rotation, rather than against the outer stationary wall. The apparatus described above with respect to FIGS. 7, 8, and 13-15 show a suitable mixed compression inlet for use with an axial compression system. Such a mixed compression inlet is shown in additional detail in FIG. 9. A mixed compression inlet is one in which part of the shock system is external to the fully enclosed portion of the aerodynamic duct defining the inlet flow path. As was earlier illustrated in FIG. 3, mixed compression inlets can be designed to operate with greater efficiencies at higher Mach numbers than normal shock inlets or external compression inlets. Also, operation at higher Mach numbers results in greater compression ratios than internal compression inlets (where all the contraction occurs within the fully enclosed part of the aerodynamic duct defining the inlet flow path), while preserving the ability to swallow the shock system, or "start" without the need for complex variable geometry features.

Figure 9:
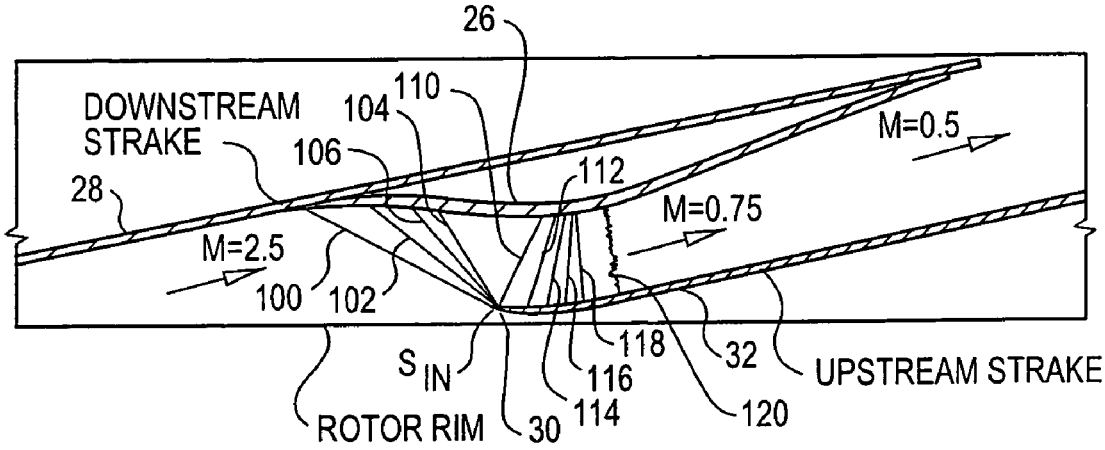
FIG. 9 illustrates the shock system generated by the compressor design just illustrated in FIGS. 7 and 8 above, when the inlet is operating at the design Mach number, so that a plurality of oblique shocks, and reflected oblique shocks, are captured between the compression ramp on the downstream strake and the upstream strake.

In FIG. 9, the downstream strake 28 is provided with compression ramp 26. A plurality of oblique shock structures 100, 102, 104, 106, are generated at the design Mach number, which in this case is M=2.5. These shocks 100, 102, 104, and 106 are captured by shock lip 30 at the inlet to the upstream strake 32. A plurality of reflected oblique shocks 110, 112, 114, 116, and 118 are illustrated downstream. Finally, a normal shock 120 is shown, after which the flow stream is operating at a Mach number of about M=0.75.

Figure 14:
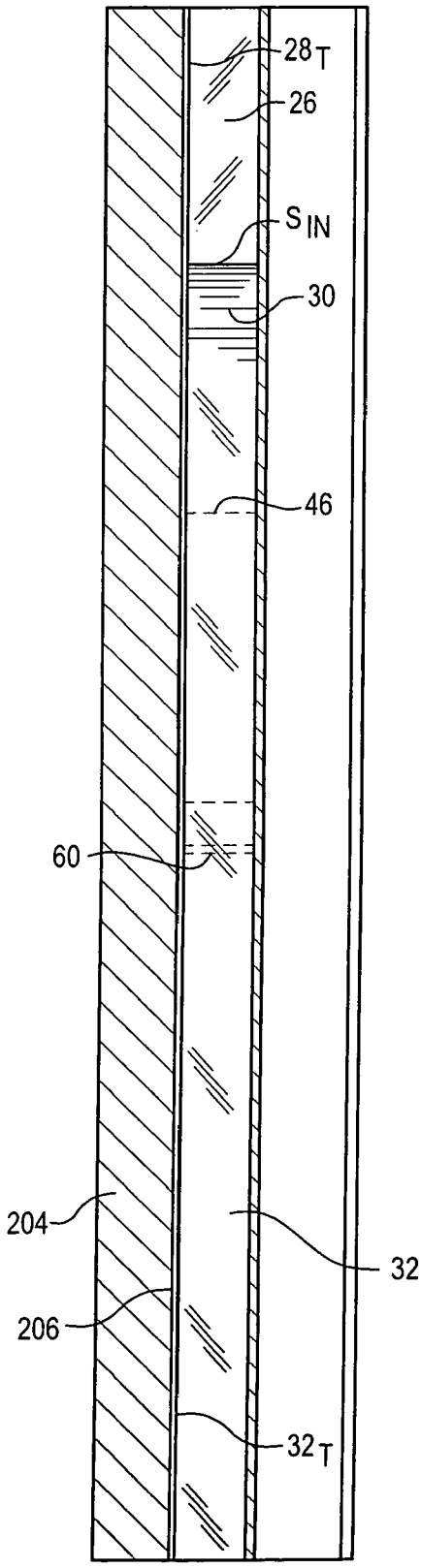
FIG. 14 shows a hypothetical vertical elevation view of the circumferential view just provided in FIG. 8 above, but now showing from the side, as if unrolled, the housing with interior peripheral wall, the outer extremity of the rotor, the downstream strake extending outward to a tip end adjacent the interior peripheral wall, the upstream strake extending outward to a tip end adjacent the interior peripheral wall, shock capture inlet lip on the upstream strake, and in phantom lines, the location of the diffuser in the gasdynamic path.
Figure 9A:
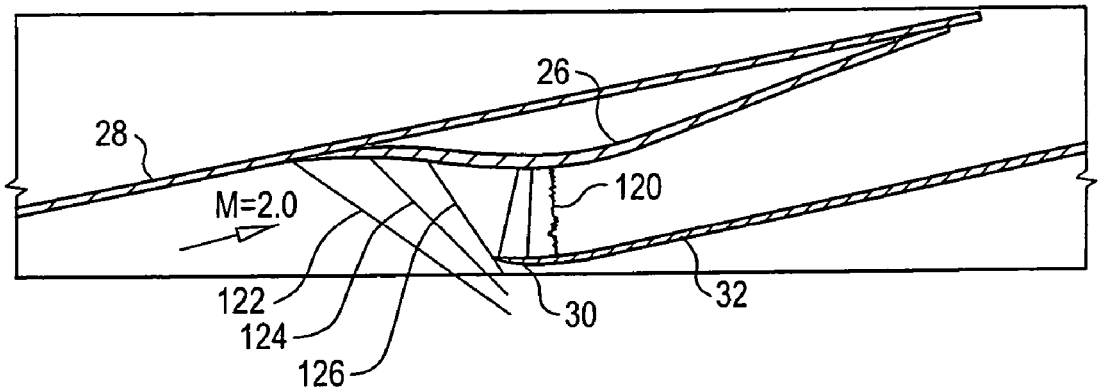
FIGS. 9*a* and 9*b* illustrate the shock system generated by the compressor design just illustrated in FIG. 9, but when operating at less than the design inlet flow Mach number, thus showing that the leading shock(s) are not captured by the shock capture lip of the upstream strake.
Figure 9B:
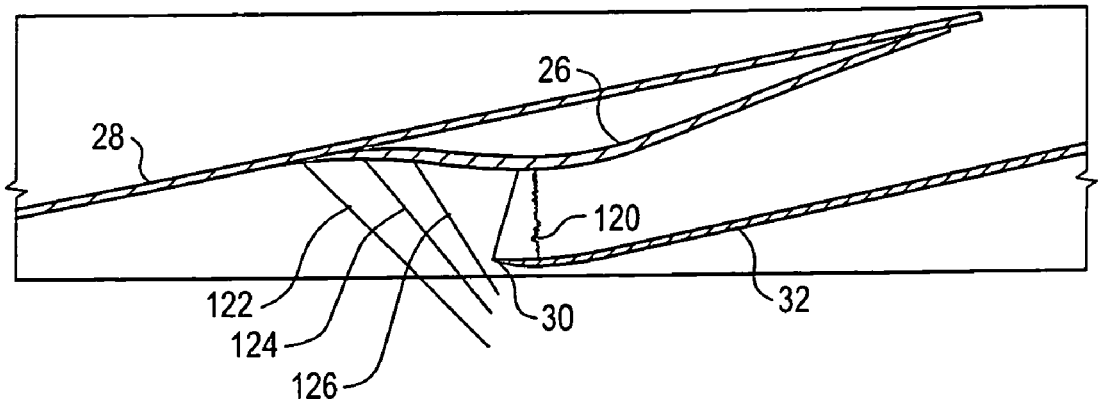

As shown in FIGS. 9*a* and 9*b*, the oblique shocks generated, i.e., 122, 124, and 126, are not captured, or are not completely captured, when compressor design first illustrated in FIGS. 7, 8, and 14 is operated at less than design Mach number.

Figure 10:
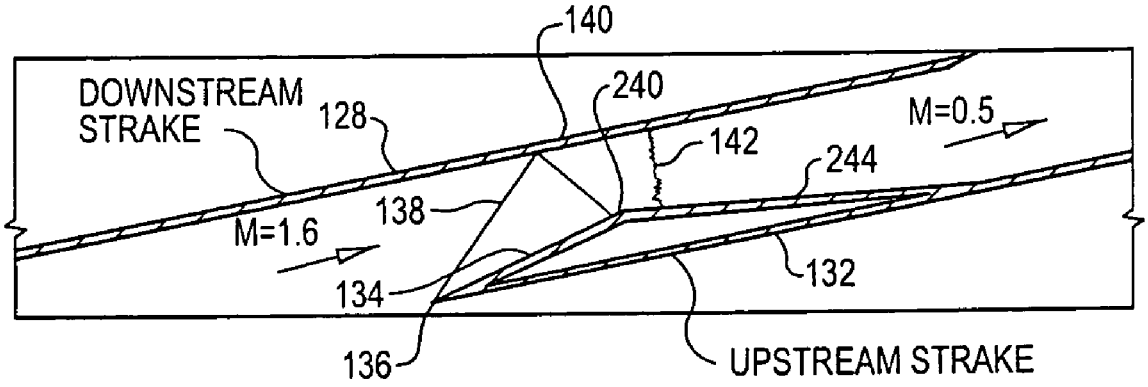
FIG. 10 shows the shock system generated by an internal compression inlet, where the compressive surface is incorporated into the upstream strake.

Turning now to FIG. 10, the use of an internal compression inlet is illustrated. Here, the downstream strake 128 does not include a compression ramp. Rather, the upstream strake 132 incorporates a compression ramp 134 having an inlet lip 136, which generates an oblique shock 138 that is captured by sidewall 140 of downstream strake 128, and reflected back against compression ramp 134. After a normal shock 142, the Mach number is reduced to about M=0.5.

Figure 11:
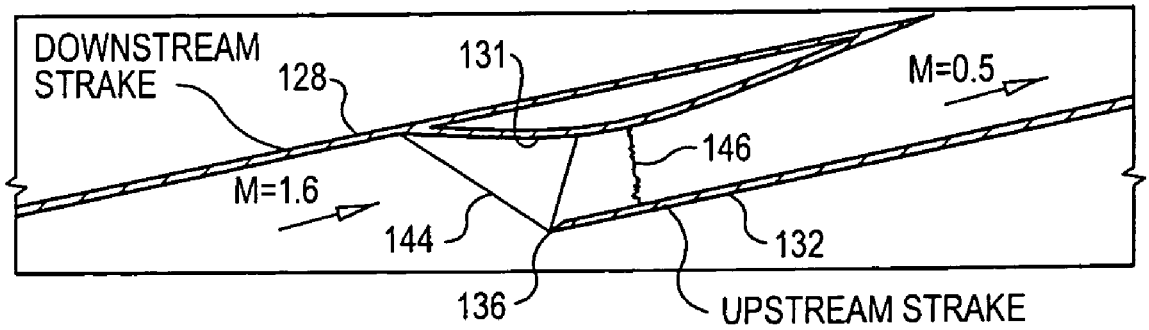
FIG. 11 shows the shock system generated by an internal compression inlet, where the compressive surface is incorporated into the downstream strake wall.

In FIG. 11, an internal compression inlet is provided. Here, the downstream strake 128 includes a compression ramp 131. Upstream strake 132 has an inlet lip 136 which captures the oblique shock 144 that is generated by compression ramp 131. After normal shock 146, the Mach number is reduced to about M=0.5.

Figure 12:
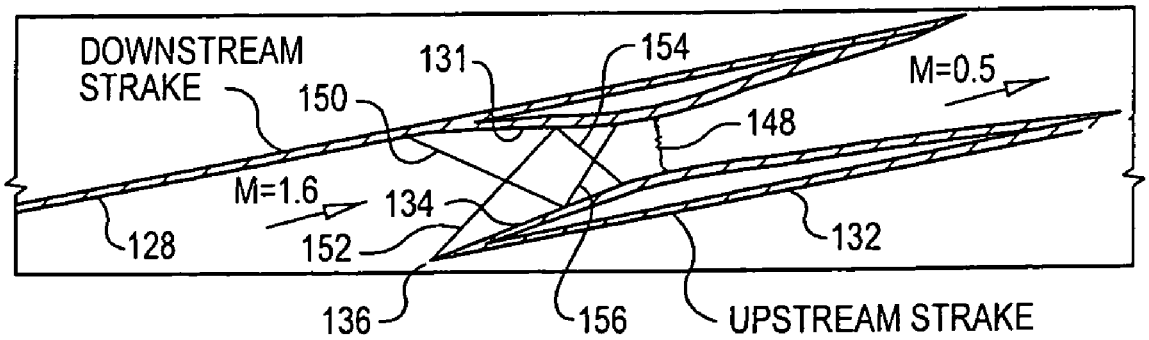
FIG. 12 shows the shock system generated by an internal compression inlet, where the compression ramp surfaces are incorporated into both the upstream and downstream strake walls.

In FIG. 12, an internal compression inlet is provided where compression ramps 131 and 134 are both provided, incorporated into the downstream 128 and upstream 132 strake walls, respectively. Compression ramps 131 and 134 generate opposing oblique shocks 150 and 152, which in turn are reflected in shocks 154 and 156. After normal shock 148, the Mach number is reduced to about M=0.5.

Figure 13:
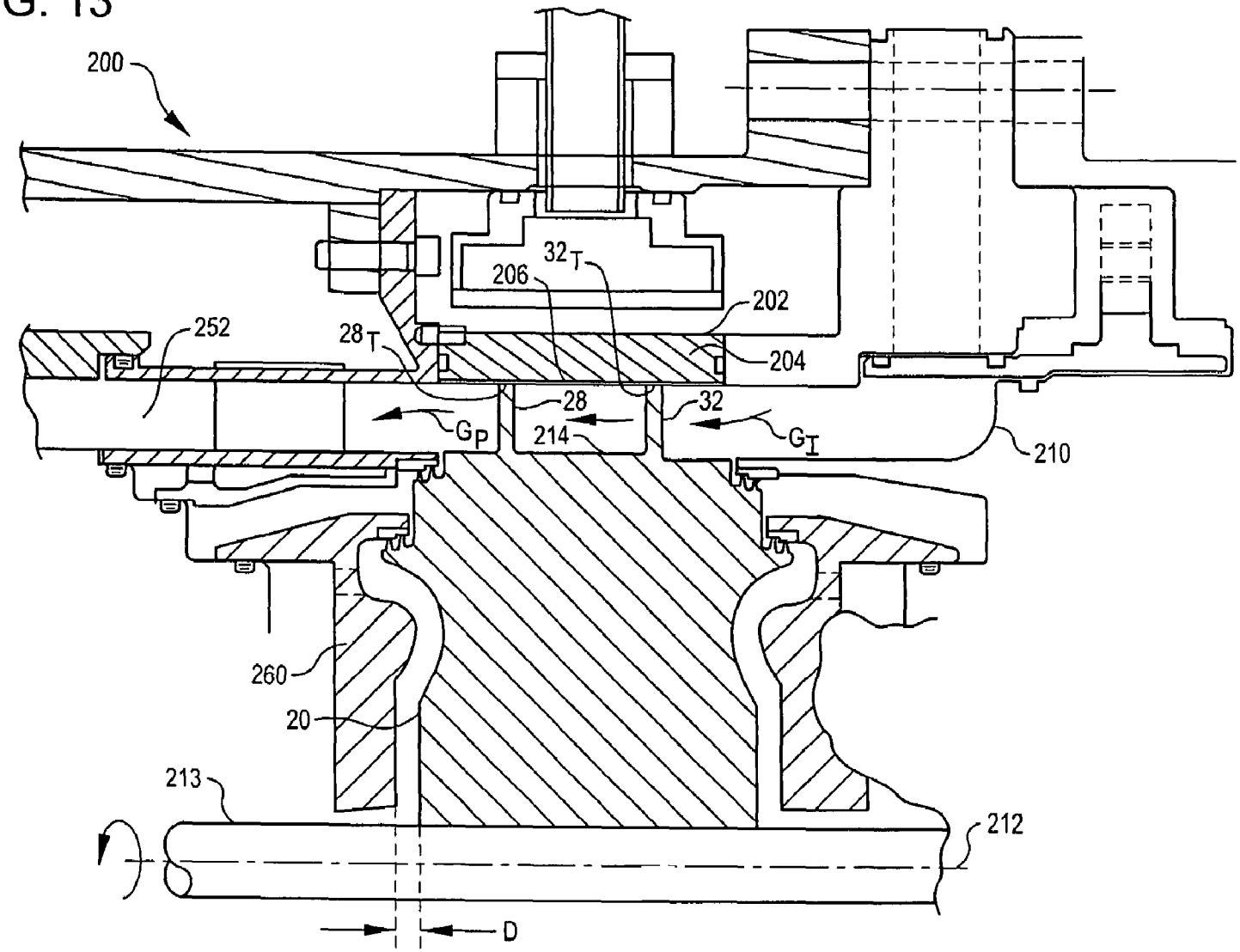
FIG. 13 provides a vertical cross-sectional view of one embodiment of a supersonic gas compressor, showing the inlet, the upstream strake, the downstream strake, and stationary peripheral housing.

Finally, in FIG. 13, a vertical cross section of a portion of one embodiment for a supersonic compressor 200 is provided. The gas compressor 200 includes a circumferential housing 202 having a stationary peripheral wall 204 with an inner surface portion 206 defined by a surface of rotation. An inlet 210 is provided for supply of gas to be compressed. A rotor 20 is provided having a central axis 212 adapted for rotary motion within housing 202 by application of mechanical energy to driving shaft 213. The rotor 20 extends radially outward from the central axis 212 to an outer surface portion 214.

One or more strakes, and, as illustrated an upstream stake 32 and a downstream stake 28 extend outward from the outer surface portion 214 of the rotor 20 to a tip end $\mathbf{28}_T$ and $\mathbf{32}_T$, respectively. Each of the tip ends $\mathbf{28}_T$ and $\mathbf{32}_T$ are adjacent the inner surface portion 206 of the stationary peripheral wall 204. As better seen in FIG. 8, at least one of the one or more strakes 28 and 32 further include (i) an upstream end having an inlet $S_{IN}$, (ii) a supersonic compression ramp 26, wherein the ramp 26 is oriented to develop an axially oriented supersonic shock (see FIG. 9) during compression of an inlet gas $G_I$. A shock capture lip 30 is provided, axially displaced from the supersonic compression ramp 26 and positioned at a location on the outer surface 24 of the rotor 20 so that the shock compression ramp 26 and the shock capture lip 30 effectively contain a supersonic shock wave 100 (see FIG. 9) therebetween at a selected design Mach number. An outlet diffuser 44 is optionally provided, situated downstream of the supersonic compression ramp 26. The one or more strakes 28, 32, etc. operate as a helical screw to separate the inlet gas $G_I$ from compressed gas $G_p$ downstream of each one of the supersonic gas compression ramps 26. Each one of the one or more strakes 28, 32, etc., in one embodiment are configured as a helical structure extending substantially radially from the outer surface portion 214 of the rotor 20 to their respective tip end $\mathbf{28}_T$ or $\mathbf{32}_T$.

As illustrated, the number of the one or more helical strakes is N, and the number of said one or more supersonic gas compression ramps is X, and N and X are equal—i.e. one gas compression ramp is provided on a downstream portion of each strake. Each one of the one or more gas compression ramps 26 includes an axially directed portion that provides an upstream narrowing gas compression ramp face 220.

Figure 15:
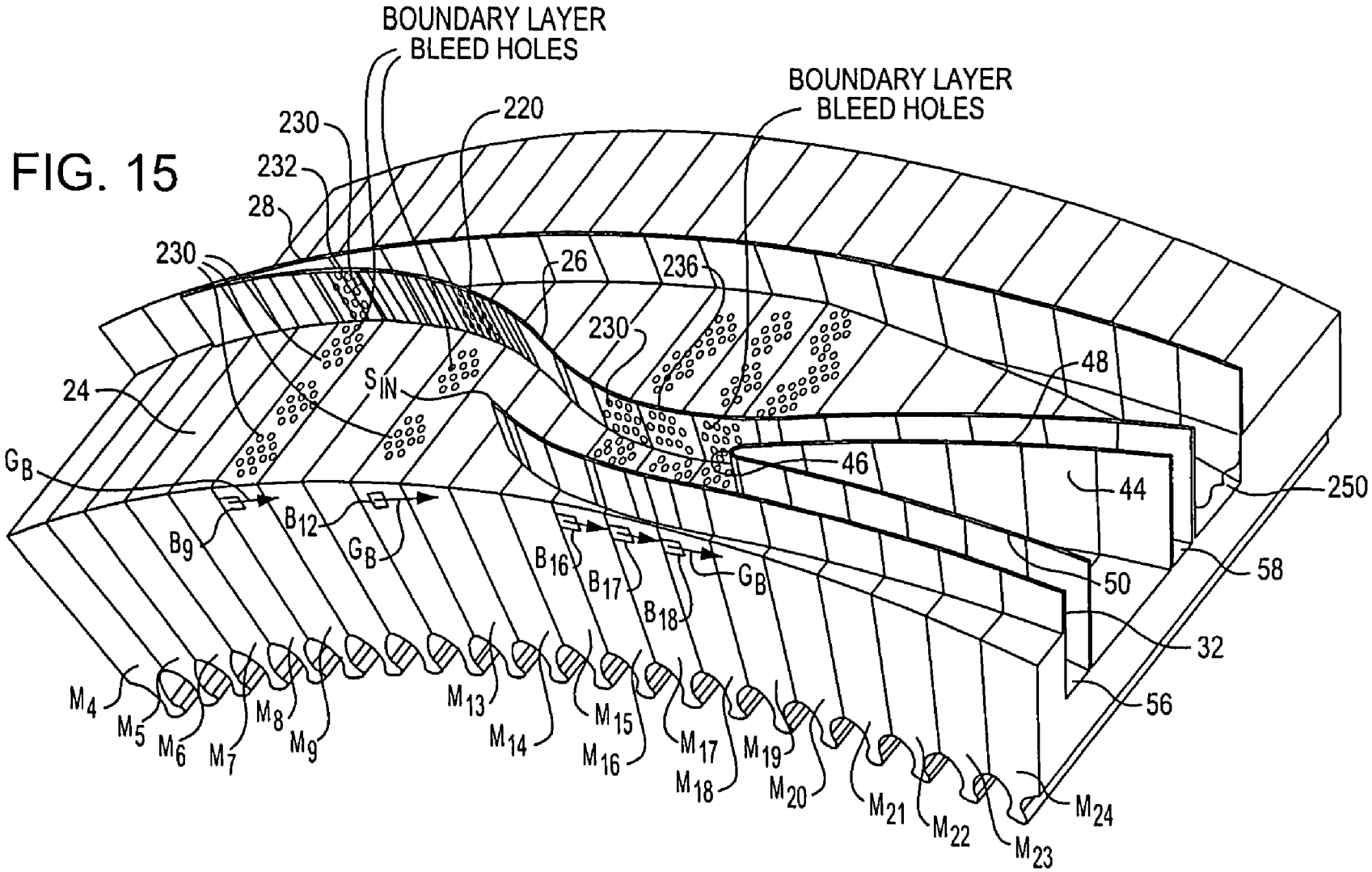
FIG. 15 shows one embodiment for incorporating boundary layer bleed holes into the base of the axial compression ramp, along the ramp itself, and at the throat between the ramp and the upstream strake, and at the adjacent rotor outer surface portion, and additionally shows outlets for discharge of accumulated bleed air from within a rim segment to the adjacent wheel space.

As further illustrated in FIG. 15, in one configuration each of the one or more gas compression ramps 26 further include one or more boundary layer bleed or holes 230. In such a configuration, at least one of the one or more boundary bleed holes 230 is located at said base 232 of a gas compression ramp 26. Also, at least one of the one or more boundary layer bleed holes 230 can be located along the working face 220 portion of the compression ramp 26. And, at least one or more of the boundary layer bleed holes 230 can be located in the throat 236 area of the compression ramp 26 adjacent the closest approach to the upstream strake 32. In still another variation, it is advantageous to include at least one of a plurality of bleed holes in the outer surface portion of 24 of the rotor, at a location adjacent each one of the locations of bleed holes in the compression ramp, namely the base 232, the face 220, or the throat 236. Additionally shown in FIG. 15 are the use of hollow rotor segments $M_8$, $M_{16}$, $M_{17}$, and $M_{18}$, which allow passage of bleed gas out into the adjacent wheel space via outlet passages $B_9$, -$B_{12}$, $B_{16}$, $B_{17}$, and $B_{18}$, respectively in the direction of reference arrows $G_B$ so that accumulated bleed gas from within a rim segment passes to the adjacent wheel space.

Especially where an inlet body diffuser 44 is not utilized, the gas compression ramps 26 may further include (a) a throat 240, and (b) an inwardly sloping gas deceleration ramp 244, as indicated in FIG. 10, for example.

Also, each of the gas compression ramps 26 may further form, adjacent thereto and in corporation with one of said at least one strakes 28 or 32, a bleed air receiving chamber 250. Each of the bleed air receiving chambers 250 effectively contains therein, for ejection therefrom, bleed air routed thereto from the bleed ports 230, such as located on face 220.

Returning now to FIG. 13, the apparatus also includes a gas outlet 252 for receiving and passing therethrough high pressure outlet gas $G_p$ resulting from compression of inlet gas $G_I$.

The apparatus just described includes supersonic shock compression of inlet gas $G_I$, utilizing the apparent velocity of gas entering the one or more gas compression ramps in excess of Mach 1. In another embodiment, the apparent velocity of gas entering the one or more gas compression ramps is in excess of Mach 2. In another embodiment, the design apparent velocity of gas entering the one or more gas compression ramps is between about Mach 1.5 and Mach 3.5.

A gas compressor configured as described herein may be provided specifically engineered to compress any selected gas, including a gas selected from the group consisting of (a) air, (b) refrigerant, (c) steam, and (d) hydrocarbons. Importantly, the compressor may compress such gases at a selected isentropic efficiency in excess of ninety (90) percent. In some cases, the compressor will compress a selected gas at an isentropic efficiency in excess of ninety five (95) percent.

Again, as noted in FIG. 13, part of the reason that such high efficiency can be attained is that the rotor includes a central disc portion that is confined within a close fitting housing having a minimal distance D between the rotor 20 the housing 260, so as to minimize aerodynamic drag on the rotor 20.

In an advantageous method of compressing gas, one or more gas compression ramps are provided on a rotor which is rotatably secured with respect to stationary housing having an inner surface. Each of the gas compression ramps is provided with an inlet gas stream, which stream is compressed by one or more gas compression ramps and contained by a stationary housing, to generate a high pressure gas $G_P$ therefrom; The high pressure gas is effectively separated from low pressure inlet gas $G_I$ by using one or more strakes along the periphery of a rotor. The strakes are helically offset by an angle delta (Δ), as indicated in FIG. 8. Each one of the one or more strakes are provided adjacent to one of one or more gas compression ramps. At least a portion of each of the one or more strakes extend outward from at least a portion of an outer surface portion of the rotor to a point adjacent an inner surface of a stationary housing. Mechanical power is applied to an input shaft that operatively drives the rotor and thus drives the one or more gas compression ramps. In practice of the method, the apparent inlet velocity of the one or more gas compression ramps is at least Mach 1.0. In one aspect of the method, the apparent inlet velocity of the one or more gas compression ramps is at least Mach 2.5. In another embodiment of the method, the inlet velocity of the one or more gas compression ramps is between Mach 2.5 and Mach 4. In yet another embodiment, the apparent inlet velocity of the gas compression ramps is approximately Mach 3.5. In practice of the method, a gas being compressed can be selected from the group consisting of (a) air, (b) steam, (c) refrigerant, and (d) hydrocarbons. In one embodiment the gas is essentially natural gas. In another embodiment, the method can be practiced to compress air. In yet another embodiment, the method can be practiced to compress a refrigerant. In a still further embodiment, the method can be practiced to compress steam. For aerodynamic and acoustic purposes, the compression ramps can be arranged and spaced equally apart circumferentially about a rotor so as to engage a supplied gas stream substantially free of turbulence from the previous passage through a given circumferential location of any one of the one or more gas compression ramps. In design of a suitable supersonic gas compressor as taught herein, the cross sectional areas of each of the throat resulting at one of the one or more gas compression ramps is sized and shaped to provide a desired compression ratio.

Turning now to FIG. 16, a partially cut away perspective view of one embodiment of a compressor 21 utilizing opposing rotors mounted on a common shaft is provided. Here, each rotor has axial compression ramps 26 as described herein, but mounted in opposing fashion along a common shaft for thrust balancing. Major components shown in this FIG. 16 include a stationary housing or case 322 having first 324 and second 326 inlets for supply of low pressure gas to be compressed, and a high pressure compressed gas outlet nozzle 328. In this dual unit design, a first rotor 330 and a second rotor 332 are provided, each having a central axis defined along centerline 334, here shown defined by common shaft 336, and adapted for rotary motion therewith, in case 322. Each one of the first 330 and second 332 rotors extends radially outward from its central axis to an outer surface portion 338, and further to an outer extremity 340 on the strakes S. On each one of first 330 and second 332 rotors, one or more axially directed supersonic shock compression ramps 26 are provided. Each one of the axially directed supersonic shock compression ramps 26 forms a feature extending outward from the outer surface portion 338 of its respective first 330 or second 332 rotor. Within housing 322, a first circumferential stationary interior peripheral wall 342 is provided radially outward from first rotor 330. Likewise a second circumferential stationary interior peripheral wall 344 is provided radially outward from second rotor 332. Each one of the stationary peripheral walls 342 and 344 are positioned radially outward from the central axis defined by centerline 334, and are positioned very slightly radially outward from the outer extremity 340 of first 330 and second 332 rotors (i.e. tips of strakes) respectively. Each one of the first and second stationary peripheral walls 342 and 344 have interior surface portion 352 and 354, respectively. Each one of the one or more supersonic shock compression ramps 346 cooperates with the interior surface portion 352 and 354 of one of the stationary peripheral walls 342 or 344 to contain gas which has been compressed by the axially directed compression ramp 346.

One or more helical strakes 28 and 32 are provided adjacent each one of the one or more supersonic compression ramps 26. An outwardly extending wall portion $\mathbf{28}_W$ or $\mathbf{32}_W$ of each of the one or more strakes 28 or 32 extends outward from at least a portion of the outer surface portion 338 of its respective rotor 330 or 332 along a height HH to a point adjacent the respective interior surface portion 352 or 354 of the peripheral wall 342 or 344. The upstream strakes 32 and the downstream strakes 28 effectively separate the low pressure inlet gas $G_I$ from high pressure compressed gas $G_P$ downstream of each one of the supersonic gas compression ramps 26. Strakes 28 and 32 are, in the embodiment illustrated by the circumferential flow paths depicted in FIGS. 7 and 8, provided in a helical structure extending substantially radially outward from the outer surface portion 24 of its respective rotor 330 or 332. In one embodiment, such as is shown in FIG. 9, the number of the one or more helical strakes is N, and the number of the one or more supersonic gas compression ramps is X, and the number N of strakes S is equal to the number X of compression ramps R. In another embodiment, as is shown in FIG. 12, the number of helical strakes is N, and the number of the one or more supersonic gas compression ramps is equal to 2N. When strakes are designated by the reference numeral S, the strakes $S_1$ through $S_N$ partition entering gas so that the gas flows to the respective gas compression ramp then incident to the inlet area for that rotor. As can be appreciated from FIG. 8, the preferably helical strakes, such as strakes $S_1$, $S_2$, and $S_3$ as shown in FIG. 7, are thin walled, with about 0.15" width (axially) at the root, and about 0.10" width at the tip. With the design illustrated herein, it is believed that leakage of compressed gases will be minimal. Thus, the strakes $S_1$ through $S_N$ allow feed of gas to each gas compression ramp without appreciable bypass of the compressed high pressure gas to the entering low pressure gas. That is, the compressed gas is effectively prevented by the arrangement of strakes S from "short circuiting" and thus avoids appreciable efficiency losses. This strake feature can be better appreciated by evaluating the details shown in FIG. 16, where strakes 28 and 32 revolves in close proximity to the interior wall surface 352. The strakes 28 and 32 have a localized height $HS_1$ and a localized height $HS_2$, respectively, which extends to a tip end $TS_1$ and $TS_2$ respectively, that is designed for rotation very near to the interior peripheral wall surface of housing 22, to allow for fitting in close proximity to the tip end $TS_1$ or $TS_2$ with the adjacent wall.

As depicted in FIG. 16 downstream of each of first 330 and second 332 rotors is a first 390 and second 392 high pressure outlet, respectively, each configured to receive and pass therethrough high pressure outlet gas resulting from compression of gas by the one or more gas compression ramps 26 on the respective rotor 330 or 332. One or more combined high pressure gas outlet nozzles 328 can be utilized, as shown in FIG. 16, to receive the combined output from the first and second high pressure outlets 390 and 392 from rotors 330 and 332.

For improved efficiency and operational flexibility, the compressor 20 may be designed to further include a first inlet casing 400 and a second inlet casing 402 having therein, respectively, first 404 and second 406 pre-swirl impellers. These pre-swirl impellers 404 and 406 are located intermediate the low pressure gas inlets 324 and 326, and their respective first 330 or second 332 rotors. Each of the pre-swirl impellers 404 and 406 are configured for compressing the low pressure inlet gas $G_I$ to provide an intermediate pressure gas stream IP at a pressure intermediate the pressure of the low pressure inlet gas $G_I$ and the high pressure outlet gas $G_P$, as noted in FIG. 16. In one application for the apparatus depicted, air at ambient atmospheric conditions of 14.7 psig is compressed to about 20 psig by the pre-swirl impellers 404 and 406. However, such pre-swirl impellers can be configured to provide a compression ratio of up to about 2:1. More broadly, the pre-swirl impellers can be configured to provide a compression ratio from about 1.3:1 to about 2:1.

Also, for improving efficiency, the gas compressor 21 can be provided in a configuration wherein, downstream of the pre-swirl impellers 404 and 406, but upstream of the one or more gas compression ramps 26 on the respective rotors 330 and 332, a plurality of inlet guide vanes, are provided, a first set 410 or 410' before first rotor 330 and a second set 412 or 412' before second rotor 332. The inlet guide vanes 410' and 412' impart a spin on gas passing therethrough so as to increase the apparent inflow velocity of gas entering the one or more gas compression ramps 26. Additionally, such inlet guide vanes 410' and 412' assist in directing incoming gas in a trajectory which more closely matches gas flow path through the ramps 26, to allow gas entering the one or more gas compression ramps 26 to be at a suitable angle, given the design rotating speed, to minimize inlet losses.

In one embodiment, as illustrated, the pre-swirl impellers 404 and 406 can be provided in the form of a centrifugal compressor wheel. As illustrated in FIG. 16, pre-swirl impellers 404 and 406 can be mounted on a common shaft 336 with the rotor 330 and 332. It is possible to customize the design of the pre-swirl impeller and the inlet guide vane set to result in a supersonic gas compression ramp inlet inflow condition with the same pre-swirl velocity or Mach number but a super-atmospheric pressure. Since the supersonic compression ramp inlet basically multiples the pressure based on the inflow pressure and Mach number, a small amount of supercharging at the pre-swirl impellers can result in a significant increase in cycle compression ratio.

With (or without) the aid of pre-swirl impellers 404 and 406, it is important that the apparent velocity of gas entering the one or more gas compression ramps 26 is in excess of Mach 1, so that the efficiency of supersonic shock compression can be exploited. However, to increase efficiency, it would be desirable that the apparent velocity of gas entering the one or more gas compression ramps 26 be in excess of Mach 2. More broadly, the apparent velocity of gas entering the one or more gas compression ramps 26 can currently practically be between about Mach 1.5 and Mach 3.5, although wider ranges are certainly possible within the teachings hereof.

It is to be appreciated that the various aspects and embodiments of the supersonic compressor designs described herein are an important improvement in the state of the art of gas compressors. Although only a few exemplary embodiments have been described in detail, various details are sufficiently set forth in the drawings and in the specification provided herein to enable one of ordinary skill in the art to make and use the invention(s), which need not be further described by additional writing in this detailed description. Importantly, the aspects and embodiments described and claimed herein may be modified from those shown without materially departing from the novel teachings and advantages provided by this invention, and may be embodied in other specific forms without departing from the spirit or essential characteristics thereof. Therefore, the embodiments presented herein are to be considered in all respects as illustrative and not restrictive. This disclosure is intended to cover the structures described herein and not only structural equivalents thereof, but also equivalent structures. Numerous modifications and variations are possible in light of the above teachings. It is therefore to be understood that within the scope of the appended claims, the invention (s) may be practiced otherwise than as specifically described herein. Thus, the scope of the invention(s), as set forth in the appended claims, and as indicated by the drawing and by the foregoing description, is intended to include variations from the embodiments provided which are nevertheless described by the broad interpretation and range properly afforded to the plain meaning of the claims set forth below.

The invention claimed is:

1. A gas compressor, said compressor comprising:

(a) a circumferential housing, said housing having a stationary peripheral wall, said stationary peripheral wall having a inner surface portion defined by a surface of rotation;

(b) an inlet for supply of gas to be compressed;

(c) a rotor, said rotor having a central axis and adapted for rotary motion within said housing, said rotor extending radially outward from said central axis to an outer surface portion;

(d) one or more strakes, each of said one or more strakes extending outward from said outer surface portion of said rotor to a tip end, said tip end adjacent to said inner surface portion of said stationary peripheral wall, at least one of said one or more strakes further comprising (i) an upstream end having an inlet, (ii) downstream from said inlet, a supersonic compression ramp, said ramp oriented to develop an axially oriented supersonic shock during compression of an inlet gas, and (iii) a shock capture lip, said shock capture lip axially displaced from said supersonic compression ramp and positioned at a location on said outer surface of said rotor so that said shock compression ramp and said shock capture lip effectively contain a supersonic shock wave therebetween at a selected design Mach number;

(e) a outlet diffuser, said diffuser situated downstream of said supersonic compression ramp; and (f) wherein said one or more strakes separate said inlet gas from compressed gas downstream of each one of said supersonic gas compression ramps.

2. The apparatus as set forth in claim 1, wherein each of said one or more strakes comprises a helical structure extending substantially radially from said outer surface portion of said rotor to said tip end.

3. The apparatus as set forth in claim 2, wherein the number of said one or more helical strakes is N, and the number of said one or more supersonic gas compression ramps is X, and wherein N and X are equal.

4. The apparatus as set forth in claim 1 or in claim 2, wherein each of said one or more gas compression ramps comprises an axially directed, upstream narrowing gas compression ramp face.

5. The apparatus as set forth in claim 1, or claim 2, wherein each of said one or more gas compression ramps further comprise one or more boundary layer bleed ports.

6. The apparatus as set forth in claim 5, wherein at least one of said one or more boundary bleed ports is located at said base of said gas compression ramps.

7. The apparatus as set forth in claim 5, wherein at least one of said one or more boundary bleed ports is located on said face of said gas compression ramp.

8. The apparatus as set forth in claim 1, wherein said gas compression ramps further comprise (a) a throat, and (b) an inwardly sloping gas deceleration ramp.

9. The apparatus as set forth in claim 5, wherein each of said gas compression ramps further form, adjacent thereto and in corporation with one of said at least one strakes, a bleed air receiving chamber, and wherein each of said bleed air receiving chambers effectively contains therein, for ejection therefrom, bleed air routed thereto.

10. The apparatus as set forth in claim 1, further comprising a gas outlet, said gas outlet configured to receive and pass therethrough high pressure outlet gas after resulting from compression of gas.

11. The apparatus as set forth in claim 1, wherein the apparent velocity of gas entering said one or more gas compression ramps is in excess of Mach 1.

12. The apparatus as set forth in claim 11, wherein the apparent velocity of gas entering said one or more gas compression ramps is in excess of Mach 2.

13. The apparatus as set forth in claim 11, wherein the design apparent velocity of gas entering said one or more gas compression ramps is between about Mach 1.5 and Mach 3.5.

14. The apparatus as set forth in claim 1, wherein said apparatus is configured to compress a gas selected from the group consisting of (a) air, (b) refrigerant, (c) steam, and (d) hydrocarbons.

15. The apparatus as set forth in claim 1, or in claim 14, wherein said apparatus compresses a selected gas at an isentropic efficiency of at least eighty percent (80%).

16. The apparatus as set forth in claim 1, or in claim 14, wherein said apparatus compresses a selected gas at an isentropic efficiency of at least eight five percent (85%).

17. The apparatus as set forth in claim 1, or in claim 14, wherein said apparatus compresses a selected gas at an isentropic efficiency of ninety (90) percent or more.

18. The apparatus as set forth in claim 1, or in claim 14, wherein said apparatus compresses a selected gas at an isentropic efficiency of ninety five (95) percent or more.

19. The apparatus of claim 1, or claim 14, wherein said rotor comprises a central disc.

20. The apparatus as set forth in claim 1, or in claim 14, wherein at least a portion of said rotor is confined within a close fitting housing having a minimal distance D between said rotor and said housing, so as to minimize aerodynamic drag on said rotor.

21. A method of compressing gas, comprising:

(a) providing one or more gas compression ramps on a rotor which is rotatably secured with respect to stationary housing having an inner surface;

(b) supplying to each of said one or more gas compression ramps an inlet gas stream;

(c) compressing said inlet gas stream between said one or more gas compression ramps and said stationary housing, to generate a high pressure gas therefrom;

(d) effectively separating inlet gas from high pressure gas by using one or more strakes along the periphery of said rotor, each of said one or more strakes provided adjacent to one of said or more gas compression ramps, and at least a portion of each of said one or more strakes extending outward from at least a portion of an outer surface portion of said rotor to a point adjacent said inner surface of said stationary housing;

(e) driving said rotor by an input shaft operatively connected to said one or more gas compression ramps.

22. The method as recited in claim 21, wherein the apparent inlet velocity of said one or more gas compression ramps is at least Mach 2.5.

23. The method as recited in claim 22, wherein the inlet velocity of said one or more gas compression ramps is between Mach 2.5 and Mach 4.

24. The method as recited in claim 23, wherein the apparent inlet velocity of said gas compression ramps is approximately Mach 3.5.

25. The method as recited in claim 24, wherein said gas is selected from the group consisting of (a) air, (b) steam, (c) refrigerant, and (d) hydrocarbons.

26. The method as recited in claim 25, wherein said gas is essentially natural gas.

27. The method as recited in claim 23, wherein said gas is air.

28. The method as recited in claim 23, wherein said gas comprises a refrigerant.

29. The method as recited in claim 23, wherein said gas comprises steam.

30. The method as recited in claim 23, wherein each of said one or more gas compression ramps are circumferentially spaced equally apart so as to engage said supplied gas stream substantially free of turbulence from the previous passage through a given circumferential location of any one said one or more gas compression ramps.

31. The method as recited in claim 30, wherein the cross sectional areas of each of the one or more gas compression ramps are sized and shaped to provide a desired compression ratio.

32. The method as set forth in claim 23, wherein the helical strakes are offset at a preselected angle delta.

33. The apparatus as set forth in claim 1, wherein said upstream strake, said downstream strake, and said compression ramp cooperate to form a mixed compression inlet.

34. The apparatus as set forth in claim 33, further comprising a centerbody diffuser downstream of said compression ramp, said diffuser bifurcating a gas dynamic flow path circumferentially about said rotor.

35. The apparatus as set forth in claim 1, wherein said upstream strake, said downstream strake, and said compression ramp cooperate to form an internal compression inlet.

36. The apparatus as set forth in claim 35, wherein said apparatus comprises a pair of opposing gas compression ramps.

37. A gas compressor, comprising:

(a) a support structure, said support structure comprising (i) a circumferential housing with an inner side surface, and (ii) a gas inlet for receiving low pressure inlet gas;

(b) a first drive shaft, said first drive shaft rotatably secured along an axis of rotation with respect to said support structure;

(c) a first rotor, said first rotor rotatably affixed with said first drive shaft for rotation with respect to said support structure, said first rotor further comprising a first circumferential portion having a first outer surface portion, said first rotor comprising one or more axially oriented gas compression ramps, each one of said gas compression ramps comprising a portion integrally provided as part of said circumferential portion of said first rotor, (d) said gas compressor adapted to utilize at least a portion of said inner side surface of said first circumferential housing to contain compressed gas thereagainst;

(e) one or more strakes on said first rotor, wherein one of said one or more strakes on said first rotor is provided for each of said one or more gas compression ramps, and wherein each of said one or more strakes on said first rotor extends outward from at least a portion of said circumferential portion of said first rotor to a point adjacent to said inner side surface of said first circumferential housing; and (f) a first high pressure compressed gas outlet.

38. The apparatus as set forth in claim 37, further comprising:

(a) a second rotor, said second rotor rotatably affixed with said first drive shaft for rotation with respect to said support structure, said second rotor further comprising a second circumferential portion having a second outer surface portion, said second rotor comprising one or more axially oriented gas compression ramps, each one of said gas compression ramps comprising a portion integrally provided as part of said circumferential portion of said second rotor, (b) said gas compressor adapted to utilize at least a portion of said inner side surface of said second circumferential housing to contain compressed gas thereagainst;

(c) one or more strakes on said second rotor, wherein one of said one or more strakes on said second rotor is provided for each of said one or more gas compression ramps, and wherein each of said one or more strakes on said second rotor extends outward from at least a portion of said circumferential portion of said second rotor to a point adjacent to said inner side surface of said second circumferential housing; and (d) a second high pressure compressed gas outlet.

39. The apparatus as set forth in claim 38, wherein said first and second high pressure gas outlets are in fluid communication with a single high pressure gas outlet nozzle.

40. The apparatus as set forth in claim 38, wherein each of said one or more strakes on said first rotor and on said second rotor comprises a helical structure extending substantially radially from said outer surface portion of said first rotor or said second rotor, respectively.

41. The apparatus as set forth in claim 40, wherein the number of said one or more helical strakes on said first rotor or on said second rotor is N, and the number of said one or more supersonic gas compression ramps on said first rotor or on said second rotor is X, and wherein N and X are equal.

42. The apparatus as set forth in claim 38, wherein each of said one or more gas compression ramps comprises an axially sloping gas compression ramp, said ramp having a base, a face, and a throat, and wherein said base is located adjacent the intersection of said axially sloping face and said downstream strake of said rotor.

43. The apparatus as set forth in claim 40 wherein each of said one or more gas compression ramps further comprise one or more boundary layer bleed ports.

44. The apparatus as set forth in claim 43, wherein at least one of said one or more boundary bleed ports is located at said base of said gas compression ramps.

45. The apparatus as set forth in claim 43, wherein at least one of said one or more boundary bleed ports is located at said face of said gas compression ramp.

46. The apparatus as set forth in claim 43, wherein at lest one of said one or more boundary bleed ports is located at said throat of said gas compression ramp.

47. The apparatus as set forth in claim 37, wherein each of said gas compression ramps further comprise a bleed air receiving chamber adjacent thereto, and wherein each of said bleed air receiving chambers effectively contains therein, for ejection therefrom, bleed air provided thereto.

48. The apparatus as set forth in claim 37, further comprising a first inlet casing containing therein a first pre swirl impeller, said first pre-swirl impeller located intermediate said gas inlet and said first rotor, said first pre swirl impeller configured for compressing said inlet gas to a pressure intermediate the pressure of said inlet gas and said outlet gas.

49. The apparatus as set forth in claim 48, further comprising a second inlet casing containing therein a second pre swirl impeller, said second preswirl impeller located intermediate said gas inlet and said second rotor, said second pre-swirl impeller configured for compressing said inlet gas to a pressure intermediate the pressure of said inlet gas and said outlet gas.

50. The apparatus as set forth in claim 49, wherein said first and said second pre-swirl impellers are configured to provide a compression ratio of up to about 2:1.

51. The apparatus as set forth in claim 50, wherein said first and said second pre-swirl impellers are configured to provide a compression ratio from about 1.3:1 to about 2:1.

52. The apparatus as set forth in claim 49, further comprising, downstream of said first and said second pre-swirl impellers and upstream of said one or more gas compression ramps on said first and said second rotors, respectively, a plurality of inlet guide vanes, said inlet guide vanes imparting spin on gas passing therethrough so as to increase the apparent inflow velocity of gas entering said one or more gas compression ramps on said first rotor and on said second rotor.

53. The apparatus as set forth in claim 49, wherein said first and said second preswirl impellers each comprise a centrifugal compressor.

54. The apparatus as set forth in claim 49, wherein said first and said second pre-swirl impeller is mounted on a common shaft with said first rotor and with said second rotor.

* * * * *

UNITED STATES PATENT AND TRADEMARK OFFICE

CERTIFICATE OF CORRECTION

PATENT NO. : 7,334,990 B2
APPLICATION NO. : 11/091680
DATED : February 26, 2008
INVENTOR(S) : Shawn P. Lawlor et al.

It is certified that error appears in the above-identified patent and that said Letters Patent is hereby corrected as shown below:

IN THE SPECIFICATION:

Column 1, line 28, after the word "applicant", insert --has--.
Column 8, line 57, delete [once] and substitute therefor --one--.
Column 9, line 24, delete [FIGS.], and substitute therefor --FIG.--.
Column 9, line 30, delete [30 strake] and substitute therefor --32--.
Column 9, line 36, delete [30] and substitute therefor --32--.
Column 11, line 26, after the word "inlet", insert --lip--.
Column 11, line 29, after the word "lip", delete [30 is] and insert --$S_{IN}$ and inlet cowl shape 30 are--.
Column 11, line 32, after the words "and the", insert --inlet cowl shape 30 and--.
Column 11, line 33, after the words "capture lip", delete [30] and substitute therefor --$S_{IN}$--.
Column 11, line 64, after the words "surface portion", delete [of].

IN THE CLAIMS:

Column 17, line 25, after the word "least", delete [eight] and substitute therefor --eighty--.
Column 18, line 53, after the words "first rotor", delete [[,]] and substitute therefor --;--.

Signed and Sealed this

Nineteenth Day of August, 2008

JON W. DUDAS
*Director of the United States Patent and Trademark Office*